US012405013B2

(12) United States Patent
Minami

(10) Patent No.: US 12,405,013 B2
(45) Date of Patent: Sep. 2, 2025

(54) AIR CONDITIONING INDOOR UNIT AND AIR CONDITIONER

(71) Applicant: DAIKIN INDUSTRIES, LTD., Osaka (JP)

(72) Inventor: Junya Minami, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 333 days.

(21) Appl. No.: 17/736,334

(22) Filed: May 4, 2022

(65) Prior Publication Data

US 2022/0260259 A1 Aug. 18, 2022

Related U.S. Application Data

(63) Continuation of application No. PCT/JP2020/041102, filed on Nov. 2, 2020.

(30) Foreign Application Priority Data

Nov. 5, 2019 (JP) ..... 2019-201070
Nov. 29, 2019 (JP) ..... 2019-217389
Nov. 29, 2019 (JP) ..... 2019-217390

(51) Int. Cl.
*F24F 1/0047* (2019.01)
*F24F 1/0007* (2019.01)
(Continued)

(52) U.S. Cl.
CPC ..... *F24F 1/0047* (2019.02); *F24F 1/00077* (2019.02); *F24F 1/005* (2019.02);
(Continued)

(58) Field of Classification Search
CPC ..... F24F 1/005; F24F 1/0047; F24F 1/0057; F25B 2600/2519
See application file for complete search history.

(56) References Cited

U.S. PATENT DOCUMENTS 2,078,295 A * 4/1937 Thatcher ..... F24F 1/0083 62/441
2011/0192184 A1 8/2011 Yamashita et al.
(Continued)

FOREIGN PATENT DOCUMENTS

CN 102112815 A 6/2011
CN 105074359 A * 11/2015 ..... F24F 3/065
(Continued)

OTHER PUBLICATIONS

International Preliminary Report on Patentability issued in corresponding International Application No. PCT/JP2020/041102 mailed May 19, 2022 (6 pages).
(Continued)

*Primary Examiner* — Ana M Vazquez
(74) *Attorney, Agent, or Firm* — Osha Bergman Watanabe & Burton LLP

(57) ABSTRACT

An air conditioning indoor unit that blows air, which has exchanged heat with a refrigerant flowing through a heat exchanger, into an air conditioning target space, includes: a liquid refrigerant pipe and a gas refrigerant pipe that are connected to the heat exchanger; a casing that accommodates the heat exchanger and that has an opening communicating with the air conditioning target space; a first shutoff valve in the liquid refrigerant pipe; a second shutoff valve in the gas refrigerant pipe; and a partition wall that separates a first space from a second space in the casing. The first shutoff valve and the second shutoff valve are in the first space. The second space communicates with the air conditioning target space via the opening.

11 Claims, 20 Drawing Sheets

(51) Int. Cl.

| | |
|---|---|
| ***F24F 1/005*** | (2019.01) |
| ***F24F 1/0057*** | (2019.01) |
| ***F24F 1/0326*** | (2019.01) |
| ***F25B 41/24*** | (2021.01) |
| ***F25B 49/02*** | (2006.01) |

(52) U.S. Cl.

CPC ..... *F24F 1/0057* (2019.02); *F24F 1/0326* (2019.02); *F25B 41/24* (2021.01); *F25B 49/02* (2013.01); *F25B 2313/0233* (2013.01); *F25B 2600/2519* (2013.01)

(56) References Cited

U.S. PATENT DOCUMENTS

| | | | |
|---|---|---|---|
| 2012/0272672 | A1 | 11/2012 | Morimoto et al. |
| 2014/0238069 | A1 | 8/2014 | Hayashi |
| 2021/0231343 | A1 | 7/2021 | Matsumoto et al. |

FOREIGN PATENT DOCUMENTS

| | | | | | |
|---|---|---|---|---|---|
| CN | 209131012 | U | | 7/2019 | |
| EP | 1512919 | A2 | | 3/2005 | |
| EP | 2051017 | A2 | * | 4/2009 | ..... F24F 1/0007 |
| EP | 3569955 | A1 | | 11/2019 | |
| GB | 2566201 | A | | 3/2019 | |
| JP | S57-077830 | U | | 5/1982 | |
| JP | H03-061794 | A | | 3/1991 | |
| JP | H08-178397 | A | | 7/1996 | |
| JP | H1078273 | A | * | 3/1998 | |
| JP | H11-230565 | A | | 8/1999 | |
| JP | 2001-74264 | A | | 3/2001 | |
| JP | 2003-90557 | A | | 3/2003 | |
| JP | 2005-241050 | A | | 9/2005 | |
| JP | 2010-7998 | A | | 1/2010 | |
| JP | 2013-19621 | A | | 1/2013 | |
| JP | 2014-163548 | A | | 9/2014 | |
| JP | 2015-230136 | A | | 12/2015 | |
| JP | 2016-84946 | A | | 5/2016 | |
| JP | 2016084946 | A | * | 5/2016 | |
| JP | 2019-45103 | A | | 3/2019 | |
| WO | 2004/020913 | A1 | | 3/2004 | |
| WO | 2011/099063 | A1 | | 8/2011 | |
| WO | WO-2018011994 | A1 | * | 1/2018 | ..... F24F 11/36 |
| WO | 2018/131085 | A1 | | 7/2018 | |
| WO | 2019049746 | A1 | | 3/2019 | |
| WO | 2019111783 | A1 | | 6/2019 | |

OTHER PUBLICATIONS

International Search Report issued in corresponding International Application No. PCT/JP2020/041102 mailed Jan. 12, 2021 (5 pages).

Extended European Search Report issued in European Application No. 20885072.7, dated Nov. 17, 2022 (10 pages).

* cited by examiner

AIR CONDITIONING INDOOR UNIT AND AIR CONDITIONER

CROSS-REFERENCE TO RELATED APPLICATIONS

This is a continuation application of International Patent Application No. PCT/JP2020/041102, filed on Nov. 2, 2020, and claims priority to Japanese Patent Application No. 2019-201070, filed on Nov. 5, 2019, Japanese Patent Application No. 2019-217389, filed on Nov. 29, 2019, and Japanese Patent Application No. 2019-217390, filed on Nov. 29, 2019. The contents of these priority applications are incorporated herein by reference.

TECHNICAL FIELD

The present disclosure relates to an air conditioning indoor unit and an air conditioner.

BACKGROUND

As disclosed in Patent Literature 1 (JP 2018/011994 W), there is known an air conditioner in which a shutoff valve is provided in a refrigerant connection pipe connecting an air conditioning outdoor unit and an air conditioning indoor unit for preventing leakage of refrigerant.

SUMMARY

An air conditioning indoor unit according to one or more embodiments blows air, which has exchanged heat with a refrigerant flowing through a heat exchanger, into an air conditioning target space. The air conditioning indoor unit includes a liquid refrigerant pipe and a gas refrigerant pipe connected to the heat exchanger, a casing, a first shutoff valve and a second shutoff valve, and a partition wall. The casing accommodates the heat exchanger. An opening communicating with the air conditioning target space is formed in the casing. The first shutoff valve and the second shutoff valve are disposed in a first space in the casing. The first shutoff valve is disposed in the liquid refrigerant pipe. The second shutoff valve is disposed in the gas refrigerant pipe. The partition wall separates the first space and a second space. The second space is a space in the casing and communicates with the air conditioning target space via the opening.

An air conditioner according to one or more embodiments includes an air conditioning indoor unit, an air conditioning heat source unit, and a shutoff valve device. The air conditioning indoor unit is installed in an air conditioning target space. The air conditioning heat source unit is connected to the air conditioning indoor unit via a liquid refrigerant pipe and a gas refrigerant pipe. The shutoff valve device includes a shutoff valve disposed in an attic space above a ceiling of an air conditioning target space. The shutoff valve includes at least one of a first shutoff valve disposed in the liquid refrigerant pipe and a second shutoff valve disposed in the gas refrigerant pipe.

An air conditioner according to one or more embodiments includes an air conditioning indoor unit, an air conditioning heat source unit, and a shutoff valve device. The air conditioning indoor unit is installed in an air conditioning target space. The air conditioning indoor unit is a floor type. The air conditioning heat source unit is connected to the air conditioning indoor unit via a liquid refrigerant pipe and a gas refrigerant pipe. The shutoff valve device includes a shutoff valve disposed in an underfloor space below a floor of an air conditioning target space. The shutoff valve includes at least one of a first shutoff valve disposed in the liquid refrigerant pipe and a second shutoff valve disposed in the gas refrigerant pipe.

DETAILED DESCRIPTION

Figure 1:
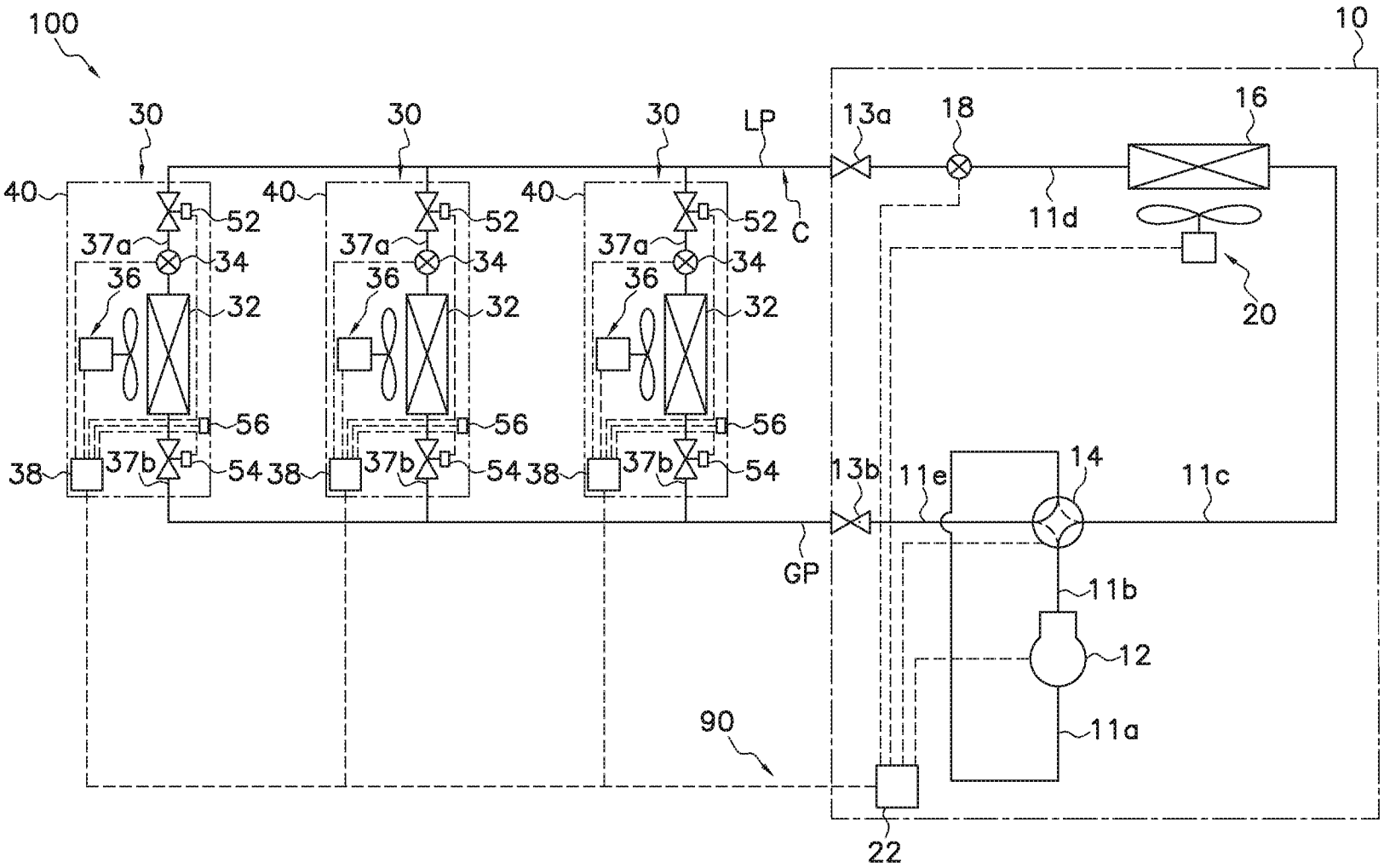
FIG. 1 is a schematic configuration diagram of an air conditioner according to one or more embodiments.

Hereinafter, an air conditioning indoor unit and an air conditioner including the air conditioning indoor unit will be described with reference to the drawings.

In the following description, for convenience of explanation, expressions such as up, down, left, right, front, and back may be used to describe directions and positional relationships. The directions indicated by these expressions follow the directions indicated by the arrows in the drawings.

First Embodiments

(1) Overall Outline

An outline of an air conditioner 100 including an air conditioning indoor unit 30 according to one or more embodiments will be described with reference to FIG. 1. FIG. 1 is a schematic configuration diagram of the air conditioner 100.

The air conditioner 100 performs a vapor compression refrigeration cycle to cool or heat an air conditioning target space R. The air conditioning target space R is, for example, a room of an office or a house. In one or more embodiments, the air conditioner 100 is capable of both cooling and heating the air conditioning target space R. However, the air conditioner of the present disclosure is not limited to an air conditioner capable of both cooling and heating, and may be, for example, a device capable of only cooling.

The air conditioner 100 mainly includes an air conditioning heat source unit 10, an air conditioning indoor unit 30, a gas-refrigerant connection pipe GP and a liquid-refrigerant connection pipe LP that connect the air conditioning heat source unit 10 and the air conditioning indoor unit 30.

In one or more embodiments, the air conditioner 100 includes three air conditioning indoor units 30. The number of the air conditioning indoor units 30 is not limited to three, but may be one, two, or four or more.

The gas-refrigerant connection pipe GP and the liquid-refrigerant connection pipe LP are laid at an installation site of the air conditioner 100. The pipe diameters and pipe lengths of the gas-refrigerant connection pipe GP and the liquid-refrigerant connection pipe LP are selected according to design specifications and installation environments.

In the air conditioner 100, the air conditioning heat source unit 10 and the air conditioning indoor unit 30 are connected by the gas-refrigerant connection pipe GP and the liquid-refrigerant connection pipe LP to form a refrigerant circuit C. The refrigerant circuit C includes a compressor 12, a heat-source heat exchanger 16, and a first expansion valve 18 of the air conditioning heat source unit 10, and a utilization heat exchanger 32 and a second expansion valve 34 of each air conditioning indoor unit 30. The refrigerant circuit C includes a first shutoff valve 52 and a second shutoff valve 54 of each air conditioning indoor unit 30.

Although not limited, a flammable refrigerant is sealed in the refrigerant circuit C. Examples of the flammable refrigerant include refrigerants categorized in Class 3 (higher flammability), Class 2 (lower flammability), and Subclass 2L (slight flammability) in the standards according to ASHRAE 34 Designation and safety classification of refrigerant in the U.S.A. or the standards according to ISO 817 Refrigerants—Designation and safety classification. Examples of the refrigerant to be used herein may include, but not limited to, R1234yf, R1234ze(E), R516A, R445A, R444A, R454C, R444B, R454A, R455A, R457A, R459B, R452B, R454B, R447B, R32, R447A, R446A, and R459A. One or more embodiments adopt R32 as the refrigerant used therein. The air conditioning indoor unit and the air conditioner of the present disclosure are also useful when the refrigerant is not flammable. The air conditioning heat source unit 10 and the air conditioning indoor unit 30 will be described in detail below.

(2) Detailed Configuration (2-1) Air Conditioning Heat Source Unit

The air conditioning heat source unit 10 will be described with reference to FIG. 1.

The air conditioning heat source unit 10 is installed, for example, on a rooftop of a building in which the air conditioner 100 is installed, in a machine room of the building, or around the building or the like.

The air conditioning heat source unit 10 mainly includes a compressor 12, a flow direction switching mechanism 14, a heat-source heat exchanger 16, a first expansion valve 18, a first fan 20, a first control unit 22, a first stop valve 13*a*, and a second stop valve 13*b* (see FIG. 1).

The air conditioning heat source unit 10 includes, as refrigerant pipes, a suction pipe 11*a*, a discharge pipe 11*b*, a first gas refrigerant pipe 11*c*, a liquid refrigerant pipe 11*d*, and a second gas refrigerant pipe 11*e* (see FIG. 1). The suction pipe 11*a* connects the flow direction switching mechanism 14 and a suction side of the compressor 12. The discharge pipe 11*b* connects a discharge side of the compressor 12 and the flow direction switching mechanism 14. The first gas refrigerant pipe 11*c* connects the flow direction switching mechanism 14 and a gas side end of the heat-source heat exchanger 16. The liquid refrigerant pipe 11*d* connects a liquid side end of the heat-source heat exchanger 16 and the liquid-refrigerant connection pipe LP. The first stop valve 13*a* is provided at a connection portion between the liquid refrigerant pipe 11*d* and the liquid-refrigerant connection pipe LP. The first expansion valve 18 is provided in the liquid refrigerant pipe 11*d*. The second gas refrigerant pipe 11*e* connects the flow direction switching mechanism 14 and the gas-refrigerant connection pipe GP. The second stop valve 13*b* is provided at a connection portion between the second gas refrigerant pipe 11*e* and the gas-refrigerant connection pipe GP.

(2-1-1) Compressor

The compressor 12 sucks and compresses a low-pressure gas refrigerant in the refrigeration cycle and discharges a high-pressure gas refrigerant in the refrigeration cycle. The compressor 12 is, for example, an inverter control-type compressor. However, the compressor 12 may be a constant-speed compressor.

(2-1-2) Flow Direction Switching Mechanism

The flow direction switching mechanism 14 is a mechanism that switches the flow direction of the refrigerant in the refrigerant circuit C according to the operation mode (cooling operation mode/heating operation mode) of the air conditioner 100. The flow direction switching mechanism 14 is a four-way switching valve.

In the cooling operation mode, the flow direction switching mechanism 14 switches the flow direction of the refrigerant in the refrigerant circuit C such that the refrigerant discharged from the compressor 12 is sent to the heat-source heat exchanger 16. Specifically, in the cooling operation mode, the flow direction switching mechanism 14 causes the suction pipe 11*a* to communicate with the second gas refrigerant pipe 11*e* and causes the discharge pipe 11*b* to communicate with the first gas refrigerant pipe 11*c* (see the solid line in FIG. 1). In the cooling operation mode, the heat-source heat exchanger 16 functions as a condenser, and the utilization heat exchanger 32 functions as an evaporator.

In the heating operation mode, the flow direction switching mechanism 14 switches the flow direction of the refrigerant in the refrigerant circuit C such that the refrigerant discharged from the compressor 12 is sent to the utilization heat exchanger 32. Specifically, in the heating operation mode, the flow direction switching mechanism 14 causes the suction pipe 11*a* to communicate with the first gas refrigerant pipe 11*c* and causes the discharge pipe 11*b* to communicate with the second gas refrigerant pipe 11*e* (see a broken line in FIG. 1). In the heating operation mode, the heat-source heat exchanger 16 functions as an evaporator, and the utilization heat exchanger 32 functions as a condenser.

The flow direction switching mechanism 14 may be realized without using a four-way switching valve. For example, the flow direction switching mechanism 14 may be configured by combining a plurality of electromagnetic valves and pipes so as to realize switching of the refrigerant flow direction as described above.

(2-1-3) Heat-Source Heat Exchanger

The heat-source heat exchanger 16 functions as a condenser of the refrigerant during the cooling operation, and functions as an evaporator of the refrigerant during the heating operation. Although not limited, the heat-source heat exchanger 16 is, for example, a fin-and-tube heat exchanger having a plurality of heat transfer tubes and a plurality of heat transfer fins.

(2-1-4) First Expansion Valve

The first expansion valve 18 is a mechanism that decompresses the refrigerant and adjusts the flow rate of the refrigerant. In one or more embodiments, the first expansion valve 18 is an electronic expansion valve whose opening degree is adjustable. The opening degree of the first expansion valve 18 is appropriately adjusted according to the operation situation. The first expansion valve 18 is not limited to the electronic expansion valve, and may be another type of expansion valve such as an automatic temperature expansion valve.

(2-1-5) First Fan

The first fan 20 is a blower that generates an air flow that flows into the air conditioning heat source unit 10 from the outside of the air conditioning heat source unit 10, passes through the heat-source heat exchanger 16, and then flows out to the outside of the air conditioning heat source unit 10. The first fan 20 is, for example, an inverter control-type fan. However, the first fan 20 may be a constant-speed fan.

(2-1-6) First Stop Valve and Second Stop Valve

The first stop valve 13*a* is a valve disposed at a connection portion between the liquid refrigerant pipe 11*d* and the liquid-refrigerant connection pipe LP. The second stop valve 13*b* is a valve disposed at a connection portion between the second gas refrigerant pipe 11*e* and the gas-refrigerant connection pipe GP. The first stop valve 13*a* and the second stop valve 13*b* are manual valves. The first stop valve 13*a* and the second stop valve 13*b* are opened when the air conditioner 100 is used.

(2-1-7) First Control Unit

The first control unit 22 controls operations of various devices of the air conditioning heat source unit 10. The first control unit 22 mainly includes a microcontroller unit (MCU), various electric circuits, and electronic circuits (not shown). The MCU includes a CPU, a memory, an I/O interface, and the like. The memory of the MCU stores various programs to be executed by the CPU of the MCU. Note that the various functions of the first control unit 22 need not be implemented by software, and may be implemented by hardware or may be implemented by cooperation of hardware and software.

The first control unit 22 is electrically connected to various devices of the air conditioning heat source unit 10 including the compressor 12, the flow direction switching mechanism 14, the first expansion valve 18, and the first fan 20 (see FIG. 1). The first control unit 22 is electrically connected to various sensors (not shown) provided in the air conditioning heat source unit 10. Although not limited, the sensors provided in the air conditioning heat source unit 10 include a temperature sensor and a pressure sensor provided in the discharge pipe 11*b* and the suction pipe 11*a*, a temperature sensor provided in the heat-source heat exchanger 16 and the liquid refrigerant pipe 11*d*, a temperature sensor that measures the temperature of the heat source air, and the like. However, the air conditioning heat source unit 10 does not need to include all these sensors.

The first control unit 22 is connected to the second control unit 38 of the air conditioning indoor unit 30 via a communication line. The first control unit 22 and the second control unit 38 exchange various signals via a communication line. The first control unit 22 and the second control unit 38 cooperate to function as a controller 90 that controls the operation of the air conditioner 100. The function of the controller 90 will be described later.

(2-2) Air Conditioning Indoor Unit

The air conditioning indoor unit 30 will be described with reference to FIGS. 2 to 5 in addition to FIG. 1.

Figure 2:
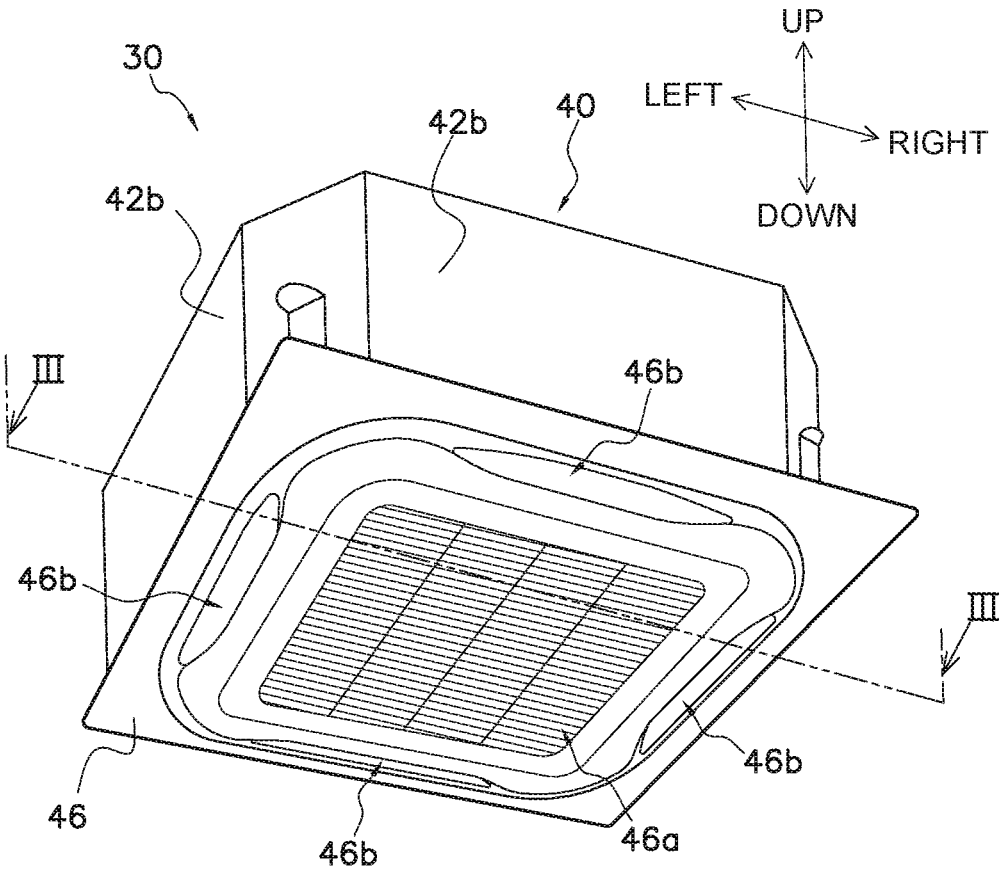
FIG. 2 is an external perspective view of an air conditioning indoor unit of the air conditioner of FIG. 1.
Figure 3:
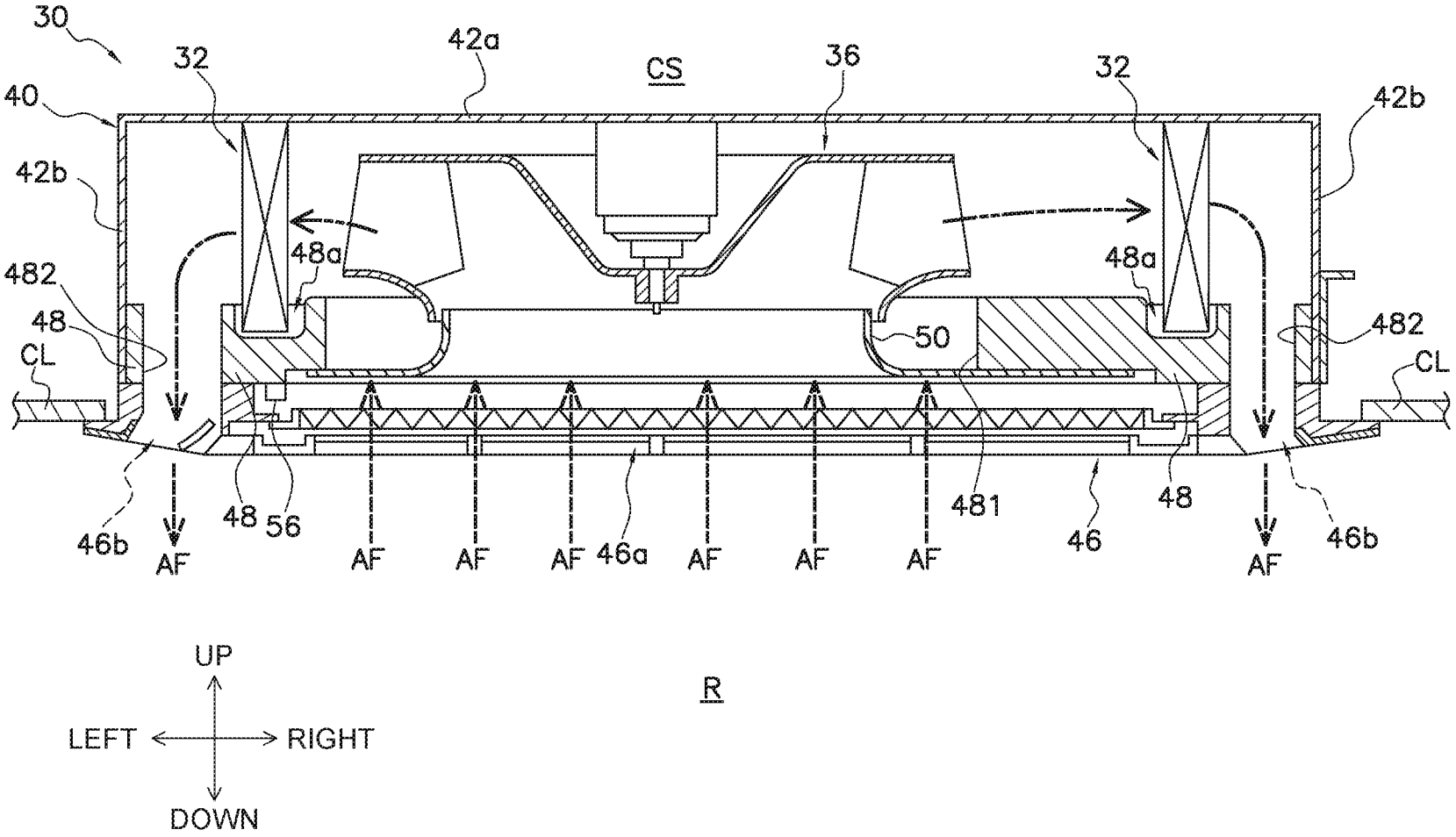
FIG. 3 is a schematic cross-sectional view of the air conditioning indoor unit attached to the ceiling, taken along line III-III in FIG. 2.
Figure 4:
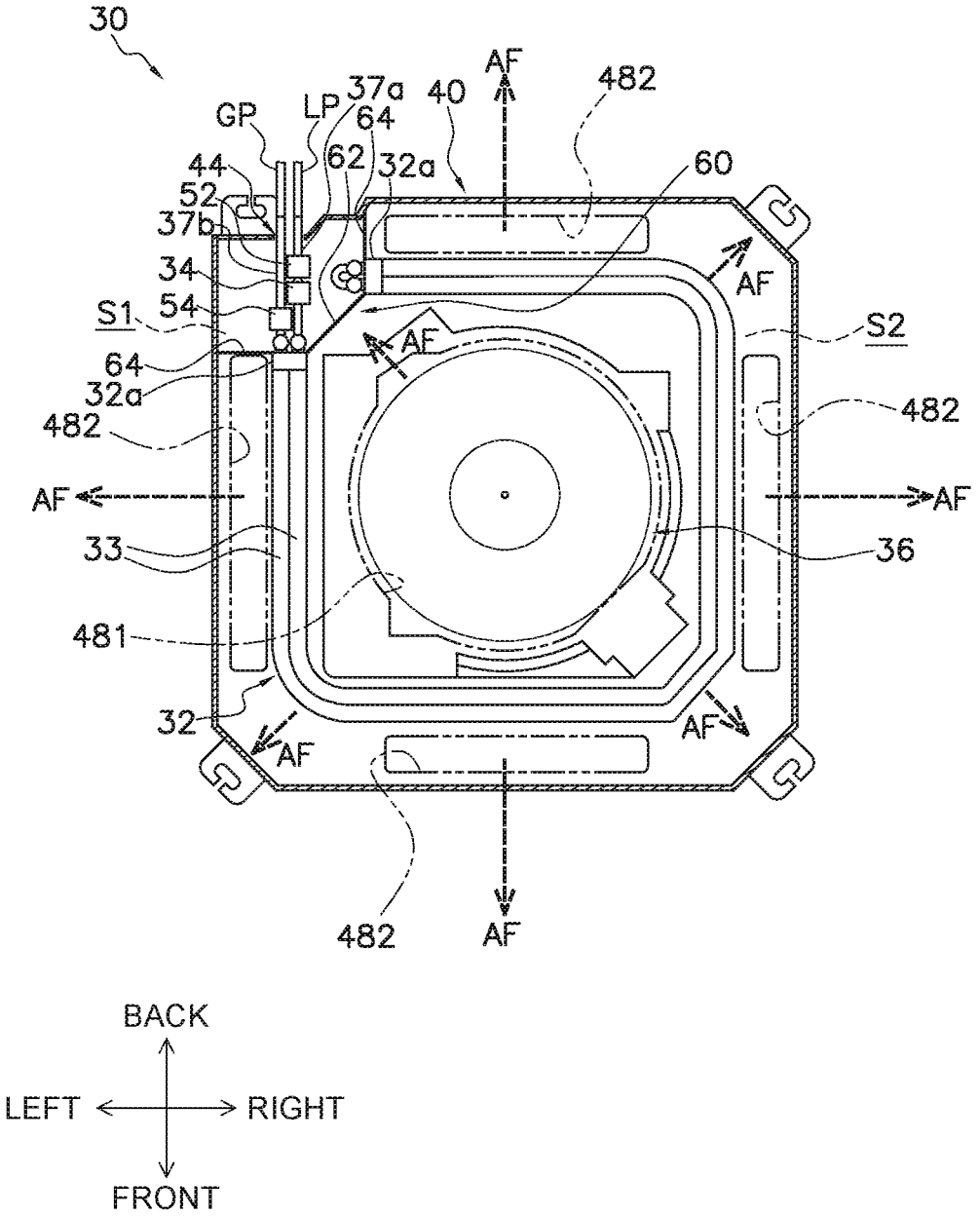
FIG. 4 is a bottom view schematically illustrating a schematic configuration of the air conditioning indoor unit in FIG. 2, illustrating the air conditioning indoor unit from which a decorative panel, a bottom plate, and the like are removed.
Figure 5:
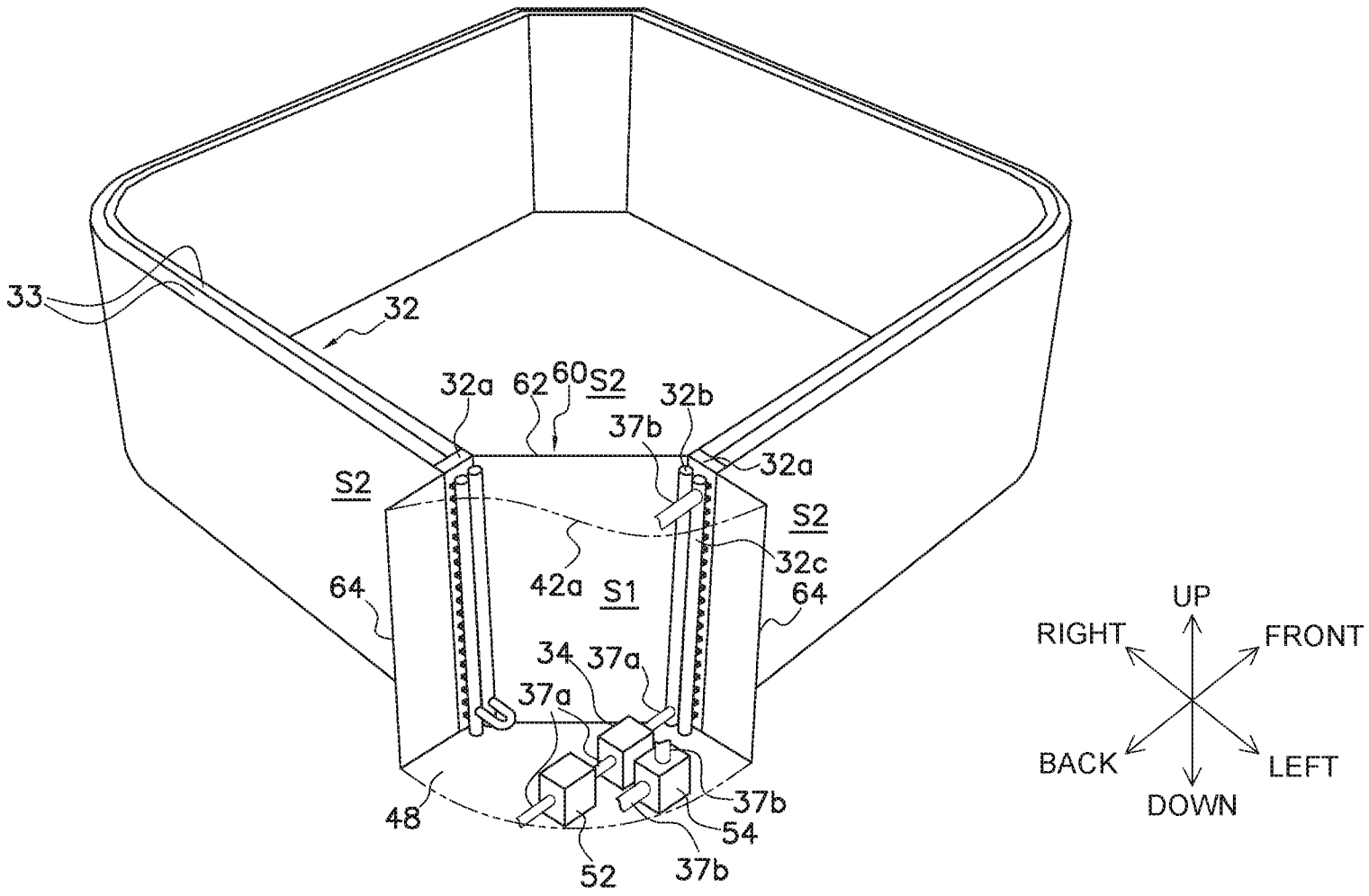
FIG. 5 is a schematic perspective view around a utilization heat exchanger for explaining a first space in which a first shutoff valve and a second shutoff valve are disposed.

FIG. 2 is an external perspective view of the air conditioning indoor unit 30. FIG. 3 is a schematic cross-sectional view of the air conditioning indoor unit 30 attached to the ceiling CL, taken along line III-III in FIG. 2. FIG. 4 is a schematic bottom view of the air conditioning indoor unit 30. FIG. 4 illustrates the air conditioning indoor unit 30 with a decorative plate 46 and a bottom plate 48 removed. FIG. 5 is a schematic perspective view around the utilization heat exchanger 32 for explaining the first space S1 in which the first shutoff valve 52 and the second shutoff valve 54 are disposed. In FIG. 5, the casing 40, the second expansion valve 34, the second fan 36, and the like are not shown from the viewpoint of visibility of the drawing.

In one or more embodiments, the air conditioner 100 includes three air conditioning indoor units 30 having the same structure. The three air conditioning indoor units 30 may not necessarily be identical. For example, the air conditioning indoor unit 30 may have different capabilities.

The air conditioning indoor unit 30 blows the air having exchanged heat with the refrigerant flowing through the use heat exchanger 32 to the air conditioning target space R. In one or more embodiments, the air conditioning indoor unit 30 is a ceiling-mounted type installed on the ceiling of the air conditioning target space R. In particular, the air conditioning indoor unit 30 according to one or more embodiments is a ceiling-embedded type air conditioning indoor unit. Examples of the ceiling-embedded type air conditioning indoor unit include a ceiling cassette-type air conditioning indoor unit in which at least a part of the air conditioning indoor unit is disposed in the attic space CS, and a duct connection type air conditioning indoor unit in which the entire air conditioning indoor unit is disposed in the attic space CS and a duct is connected. However, the type of the air conditioning indoor unit 30 is not limited to the ceiling-embedded type, and may be a ceiling-suspended type. The air conditioning indoor unit 30 may be of a type other than a ceiling-mounted type such as a wall-mounted type or a floor type.

As shown in FIGS. 1 and 3, the air conditioning indoor unit 30 mainly includes a casing 40, a utilization heat exchanger 32, a second expansion valve 34, a second fan 36, a first shutoff valve 52, a second shutoff valve 54, a refrigerant detector 56, and a second control unit 38.

The air conditioning indoor unit 30 also includes, as refrigerant pipes, a liquid refrigerant pipe 37*a* and a gas refrigerant pipe 37*b* connected to the utilization heat exchanger 32 (see FIG. 1). The liquid refrigerant pipe 37*a* connects the liquid-refrigerant connection pipe LP and the liquid side of the utilization heat exchanger 32. The liquid refrigerant pipe 37*a* is provided with a first shutoff valve 52. A second expansion valve 34 is provided between the first shutoff valve 52 and the utilization heat exchanger 32 in the liquid refrigerant pipe 37*a*. The gas refrigerant pipe 37*b* connects the gas-refrigerant connection pipe GP and the gas side of the utilization heat exchanger 32. The gas refrigerant pipe 37*b* is provided with a second shutoff valve 54.

(2-2-1) Casing

The casing 40 accommodates various devices of the air conditioning indoor unit 30. The various devices accommodated in the casing 40 mainly include the utilization heat exchanger 32, the second expansion valve 34, the second fan 36, the first shutoff valve 52, and the second shutoff valve 54 (see FIGS. 3 and 4).

As illustrated in FIG. 3, the casing 40 is inserted into an opening formed in the ceiling CL of the target space, and is installed in the attic space CS formed between the ceiling CL and the floor surface of the upper floor or between the ceiling CL and the roof. The casing 40 includes a top panel 42*a*, side walls 42*b*, a bottom plate 48, and a decorative plate 46 (see FIGS. 2 and 3).

The top panel 42*a* is a member constituting a top surface portion of the casing 40. In a plan view, the top panel 42*a* has a substantially quadrangular shape (see FIG. 4).

The side wall 42*b* is a member constituting a side surface portion of the casing 40. The side wall 42*b* extends downward from the top panel 42*a*. The side wall 42*b* has a substantially quadrangular prism shape corresponding to the shape of the top panel 42*a*. Although the material is not limited, the side wall 42*b* and the top panel 42*a* are made of sheet metal, for example. The side wall 42*b* and the top panel 42*a* are integrally formed, and, as a whole, have a substantially quadrangular box shape in a plan view with a lower surface opened. An opening 44 through which the liquid refrigerant pipe 37*a* and the gas refrigerant pipe 37*b* connected to the utilization heat exchanger 32 are inserted is formed in the side wall 42*b* (see FIG. 4). The liquid-refrigerant connection pipe LP is connected to an end of the liquid refrigerant pipe 37*a* disposed outside the casing 40. The gas-refrigerant connection pipe GP is connected to an end of the gas refrigerant pipe 37*b* disposed outside the casing 40. For example, a flare nut is used for connection between the liquid refrigerant pipe 37*a* and the liquid-refrigerant connection pipe LP and connection between the gas refrigerant pipe 37*b* and the gas-refrigerant connection pipe GP. The connection between the liquid refrigerant pipe 37*a* and the liquid-refrigerant connection pipe LP and the connection between the gas refrigerant pipe 37*b* and the gas-refrigerant connection pipe GP may be performed by welding or brazing.

The bottom plate 48 is a member constituting a bottom surface portion of the casing 40. The material of the bottom plate 48 is not limited, but the bottom plate is made of styrene foam. A part of the bottom plate 48 functions as a drain pan. Specifically, a first portion 48*a* of the bottom plate 48 which is disposed below the utilization heat exchanger 32 and has a groove recessed downward for receiving the condensed water functions as a drain pan. As illustrated in FIGS. 3 and 4 (indicated by a two-dot chain line in FIG. 4), a suction opening 481 having a substantially circular shape in a plan view is formed at the center of the bottom plate 48. A bell mouth 50 is disposed at the suction opening 481. As shown in FIGS. 3 and 4 (indicated by a two-dot chain line in FIG. 4), a plurality of blow-out openings 482 are formed around the suction opening 481 of the bottom plate 48. As shown in FIGS. 2 and 3, the decorative plate 46 is attached to the lower surface side of the bottom plate 48.

The decorative panel 46 is a plate-shaped member exposed to the air conditioning target space R. The decorative plate 46 has a substantially quadrangular shape in a plan view. The decorative plate 46 is installed by being fitted into an opening of the ceiling CL (see FIG. 3). The decorative plate 46 includes an air suction port 46*a* and a plurality of blow-out ports 46*b*. The suction port 46*a* is formed in a substantially quadrangular shape in a central portion of the decorative plate 46 at a position partially overlapping the suction opening 481 of the bottom plate 48 in a plan view. The plurality of blow-out ports 46*b* are formed around the suction port 46*a* of the decorative plate 46 so as to surround the suction port 46*a*. Each of the blow-out ports 46*b* is disposed at a position corresponding to the blow-out opening 482 of the bottom plate 48. When the second fan 36 is operated, air sucked from the suction port 46*a* flows into the casing 40 through the suction opening 481. The air that has flowed into the casing 40 and passed through the utilization heat exchanger 32 is blown out from the blow-out opening 482 and is blown out into the air conditioning target space R from the blow-out port 46*b* corresponding to the blow-out opening 482 (see FIG. 3).

The arrangement of devices, components, and spaces in the casing 40 will be described.

As illustrated in FIG. 4, the second fan 36 is disposed at the center of the casing 40 in a plan view. As illustrated in FIG. 3, a bell mouth 50 is provided below the second fan 36. As illustrated in FIG. 4, in a plan view, a utilization heat exchanger 32 is provided around the second fan 36 so as to surround the second fan 36. As described above, the groove recessed downward is formed in the first portion 48*a* of the bottom plate 48 disposed below the utilization heat exchanger 32. The first portion 48*a* of the bottom plate 48 functions as a drain pan that receives condensed water generated in the utilization heat exchanger 32 (see FIG. 3).

In a plan view, as shown in FIG. 4, a first space S1 separated from the second space S2 by a partition wall 60 is formed at one of the corners of the casing 40. The second space S2 communicates with the air conditioning target space R through the suction port 46*a* and the suction opening 481, and the blow-out opening 482 and the blow-out port 46*b*. The second space S2 includes an air flow path through which air flows from the suction port 46*a* to the blow-out port 46*b* via the utilization heat exchanger 32 during operation of the second fan 36. The presence of the partition wall 60 suppresses the flow of air between the first space S1 and the second space S2. Therefore, even if the refrigerant leaks in the first space S1, the inflow of the refrigerant from the first space S1 to the second space S2 is suppressed. Furthermore, even if the refrigerant leaks in the first space S1, the inflow of the refrigerant from the first space S1 to the air conditioning target space R via the second space S2 is suppressed.

The air may not flow between the first space S1 and the second space S2. Here, "air may not flow between the first space S1 and the second space S2" means that there is substantially no air flow, and the first space S1 and the second space S2 may not be sealed in an airtight state.

As shown in FIGS. 4 and 5, the first space S1 is a space formed such that the upper side is surrounded by the top panel 42*a* of the casing 40, the lateral sides are surrounded by the side wall 42*b* and the partition wall 60 of the casing 40, and the lower side is surrounded by the bottom plate 48. So as not to communicate the first space S1 and the second space S2 each other, the portion of the bottom plate 48 surrounding the first space S1 does not include the first portion 48*a* functioning as a drain pan.

The partition wall 60 is a plate-like member here. The partition wall 60 is attached to, for example, a tube plate 32*a* of the utilization heat exchanger 32. The tube plate 32*a* is a member for fixing a plurality of heat transfer tubes (not shown) of the utilization heat exchanger 32, and is provided at both ends of the heat transfer tubes. The partition wall 60 includes a first member 62 connecting the two tube plates 32*a* of the utilization heat exchanger 32 and a second member 64 extending from the tube plates 32*a* toward the side wall 42*b* of the casing 40. The second member 64 may come into contact with the side wall 42*b* directly or indirectly via another member. Since the partition wall 60 and the side wall 42*b* are in direct or indirect contact with each other, the flow of air between the first space S1 and the second space S2 is easily suppressed. The partition wall 60 may be in contact with the top panel 42*a* and the bottom plate 48 of the casing 40 directly or indirectly via another member. Since the partition wall 60 is in direct or indirect contact with the top panel 42*a* and the bottom plate 48, the flow of air between the first space S1 and the second space S2 is easily suppressed. Note that a sealing material may be appropriately used in order to suppress the flow of air between the first space S1 and the second space S2. Note that the structure for forming the first space S1 described here is merely an example, and the first space S1 may be formed in another manner. For example, the upper side of the first space S1 may be surrounded by a member separate from the casing 40 instead of the top panel 42*a* of the casing 40. The lower side of the first space S1 may be surrounded by a member that is not formed integrally with the bottom plate 48 of the casing 40.

An opening 44 through which the liquid refrigerant pipes 37*a* and the gas refrigerant pipes 37*b* pass is formed in the side wall 42*b* of the casing 40 that forms the first space S1, in other words, that surrounds the first space S1. The first space S1 and the attic space CS in which the casing 40 is installed communicate with each other via the opening 44. The first space S1 and the attic space CS may communicate with each other via the opening 44, but gaps between the liquid refrigerant pipe 37*a* and the gas refrigerant pipe 37*b* and the opening 44 may be closed by a sealing material or the like.

The second expansion valve 34, the first shutoff valve 52, and the second shutoff valve 54 are disposed in the first space S1. The second expansion valve 34, the first shutoff valve 52, and the second shutoff valve 54 are disposed, for example, at a lower part of the first space S1. However, the present disclosure is not limited to this, and the position in which the second expansion valve 34, the first shutoff valve 52, and the second shutoff valve 54 are disposed in the first space S1 may be appropriately determined. The position of the first space S1 described here is an example, and the first space S1 may be formed at a place other than the corner of the casing 40 in a plan view.

(2-2-2) Indoor Heat Exchanger

The utilization heat exchanger 32 is an example of the heat exchanger. In the utilization heat exchanger 32, heat is exchanged between the refrigerant flowing through the utilization heat exchanger 32 and air.

The type of the utilization heat exchanger 32 is not limited, and is, for example, a fin-and-tube heat exchanger having a plurality of heat transfer tubes and a plurality of heat transfer fins.

Although the shape and structure are not limited, the utilization heat exchanger 32 illustrated in FIGS. 4 and 5 has a plurality of rows of heat exchange units 33 in which a plurality of heat transfer tubes are vertically arranged and stacked. Here, the utilization heat exchanger 32 includes two rows of heat exchange units 33. The heat exchange units 33 of the utilization heat exchanger 32 are arranged along the flow direction of the air generated by the second fan 36. Tube plates 32*a* for fixing the heat transfer tubes are provided at both ends of the heat exchange unit 33. As shown in FIG. 4, the heat exchange unit 33 of the utilization heat exchanger 32 is bent by about 90 degrees at three points in a plan view, and is disposed in a substantially quadrangular shape. The utilization heat exchanger 32 is disposed so as to surround the suction port 46*a* and to be surrounded by the blow-out port 46*b* in a plan view. The utilization heat exchanger 32 is disposed so as to surround the periphery of the second fan 36.

As illustrated in FIG. 1, the liquid refrigerant pipe 37*a* is connected to one end of the utilization heat exchanger 32. As illustrated in FIG. 1, the gas refrigerant pipe 37*b* is connected to the other end of the utilization heat exchanger 32. Specifically, in one or more embodiments, the liquid refrigerant pipe 37*a* is connected to a first header 32*b* of the utilization heat exchanger 32. The gas refrigerant pipe 37*b* is connected to a second header 32*c* of the utilization heat exchanger 32.

During the cooling operation, the refrigerant flows from the liquid refrigerant pipe 37*a* into the utilization heat exchanger 32, and the refrigerant having exchanged heat with air in the heat exchange unit 33 of the utilization heat exchanger 32 flows out from the gas refrigerant pipe 37*b*. During the heating operation, the refrigerant flows from the gas refrigerant pipe 37*b* into the utilization heat exchanger 32, and the refrigerant having exchanged heat with air in the heat exchange unit 33 of the utilization heat exchanger 32 flows out from the liquid refrigerant pipe 37*a*.

(2-2-3) Second Expansion Valve

The second expansion valve 34 is a mechanism that decompresses the refrigerant and adjusts the flow rate of the refrigerant. In one or more embodiments, the second expansion valve 34 is an electronic expansion valve whose opening degree is adjustable. The opening degree of the second expansion valve 34 is appropriately adjusted according to the operation situation. The second expansion valve 34 is not limited to the electronic expansion valve, and may be another type of expansion valve such as an automatic temperature expansion valve.

(2-2-4) Second Fan

The second fan 36 is a blower that supplies air to the utilization heat exchanger 32. The second fan 36 is, for example, a centrifugal fan such as a turbo fan or a sirocco fan. The second fan 36 is, for example, but not limited to, an inverter control-type fan.

When the second fan 36 is operated, the air in the air conditioning target space R flows into the casing 40 of the air conditioning indoor unit 30 from the suction port 46*a* of the decorative plate 46, passes through the bell mouth 50, is sucked into the second fan 36, and is blown out in four directions from the second fan 36. The air blown out by the second fan 36 passes through the utilization heat exchanger 32 toward the blow-out port 46*b*, and is blown out from the blow-out port 46*b* into the air conditioning target space R. At least a portion of the second space S2 functions as a flow path of air through which air flows in the above-described manner during operation of the second fan 36. Since the partition wall 60 is present, the air blown out by the second fan 36 hardly flows into the first space S1.

(2-2-5) First Shutoff Valve and Second Shutoff Valve

The first shutoff valve 52 and the second shutoff valve 54 suppress the leakage of refrigerant into the air conditioning target space R when the leakage of refrigerant from the refrigerant circuit C. The first shutoff valve 52 and the second shutoff valve 54 are, for example, electromagnetic valves capable of switching between a closed state (fully closed) and an open state (fully open). However, the types of the first shutoff valve 52 and the second shutoff valve 54 are not limited to the electromagnetic valve, and may be, for example, an electric valve.

The first shutoff valve 52 and the second shutoff valve 54 are opened in a normal state (when the refrigerant detector 56 does not detect the leakage of refrigerant). When the refrigerant detector 56 of the air conditioning indoor unit 30 detects the leakage of refrigerant, the first shutoff valve 52 and the second shutoff valve 54 of the air conditioning indoor unit 30 are closed. When the first shutoff valve 52 and the second shutoff valve 54 are closed while the refrigerant leaks from the air conditioning indoor unit 30, the inflow of the refrigerant into the air conditioning indoor unit 30 from the air conditioning heat source unit 10, the pipe connecting the air conditioning heat source unit 10 and the first shutoff valve 52, or the pipe connecting the air conditioning heat source unit 10 and the second shutoff valve 54 is suppressed.

(2-2-6) Refrigerant Detector

The refrigerant detector 56 is a sensor that detects the leakage of refrigerant at the air conditioning indoor unit 30.

The refrigerant detector 56 is provided in the casing 40 of the air conditioning indoor unit 30, for example. As illustrated in FIG. 3, the refrigerant detector 56 is attached to the bottom surface of the bottom plate 48 disposed below the utilization heat exchanger 32. The refrigerant detector 56 may be attached to a place other than the bottom plate 48, for example, a bottom surface of a member connecting the bell mouth 50 and the bottom plate 48, a bottom surface of the bell mouth 50, an inner surface of the top panel 42*a* or the side wall 42*b*, or the like. The refrigerant detector 56 may be disposed outside the casing 40 of the air conditioning indoor unit 30. A plurality of refrigerant detectors 56 may be provided.

The refrigerant detector 56 is, for example, a semiconductor-type sensor. The semiconductor refrigerant detector 56 includes a semiconductor-type detection element (not shown). The semiconductor detector element has electric conductivity that changes depending on whether it is in a case where no refrigerant gas exists therearound and in a case where refrigerant gas exists therearound. When the refrigerant gas exists around the semiconductor-type detection element, the refrigerant detector 56 outputs a relatively large current as a detection signal. On the other hand, when the refrigerant gas does not exist around the semiconductor-type detection element, the refrigerant detector 56 outputs a relatively small current as a detection signal.

The type of the refrigerant detector 56 is not limited to the semiconductor type, and may be any sensor capable of detecting refrigerant gas. For example, the refrigerant detector 56 may be an infrared sensor that outputs a detection signal according to a detection result of the refrigerant.

(2-2-7) Second Control Unit

The second control unit 38 controls operations of various devices of the air conditioning indoor unit 30. The second control unit 38 includes a microcontroller unit (MCU), various electric circuits, and electronic circuits (not shown). The MCU includes a CPU, a memory, an I/O interface, and the like. The memory of the MCU stores various programs to be executed by the CPU of the MCU. Note that the various functions of the second control unit 38 need not be implemented by software, and may be implemented by hardware or may be implemented by cooperation of hardware and software.

The second control unit 38 is electrically connected to various devices of the air conditioning indoor unit 30 including the second expansion valve 34, the second fan 36, the first shutoff valve 52, and the second shutoff valve 54 (see FIG. 1). The second control unit 38 is electrically connected to the refrigerant detector 56. The second control unit 38 is electrically connected to a sensor (not shown) provided in the air conditioning indoor unit 30. The sensor (not shown) includes, but is not limited to, a temperature sensor provided in the utilization heat exchanger 32 and the liquid refrigerant pipe 37*a*, a temperature sensor that measures the temperature of the air conditioning target space R, and the like.

The second control unit 38 is connected to the first control unit 22 of the air conditioning heat source unit 10 via a communication line. The second control unit 38 is communicably connected to a remote control unit for operating the air conditioner 100 (not shown) via a communication line. The first control unit 22 and the second control unit 38 cooperate to function as a controller 90 that controls the operation of the air conditioner 100.

The function of the controller 90 will be described. Some or all of various functions of the controller 90 described below may be executed by a control device provided separately from the first control unit 22 and the second control unit 38.

The controller 90 controls the operation of the flow direction switching mechanism 14 such that the heat-source heat exchanger 16 functions as a condenser of the refrigerant and the utilization heat exchanger 32 functions as an evaporator of the refrigerant during the cooling operation. The controller 90 controls the operation of the flow direction switching mechanism 14 such that the heat-source heat exchanger 16 functions as an evaporator of the refrigerant and the utilization heat exchanger 32 functions as a condenser of the refrigerant during the heating operation. The controller 90 operates the compressor 12, the first fan 20, and the second fan 36 during the cooling operation and the heating operation. During the cooling operation and the heating operation, the controller 90 adjusts the numbers of rotations of the motors of the compressor 12, the first fan 20, and the second fan 36 and the opening degrees of the first expansion valve 18 and the second expansion valve 34 based on the measurement values of the various temperature sensors and the pressure sensors, the set temperatures, and the like. Since various control modes are generally known for the control of the operations of the various devices of the air conditioner 100 during the cooling operation and the heating operation, the description thereof will be omitted here to avoid complication of the description.

In addition to the control of the normal operation of the air conditioner 100, the controller 90 performs the following control when the refrigerant is detected by the refrigerant detector 56 of any of the air conditioning indoor units 30. The case where the refrigerant is detected by the refrigerant detector 56 means a case where the value of the current output as the detection signal by the refrigerant detector 56 is larger than a predetermined threshold.

When the refrigerant is detected by the refrigerant detector 56 of any of the air conditioning indoor units 30, the controller 90 closes the first shutoff valve 52 and the second shutoff valve 54 of the air conditioning indoor unit 30. When the refrigerant is detected by the refrigerant detector 56 of any of the air conditioning indoor units 30, the controller 90 may notify the leakage of refrigerant using an alarm (not shown) in addition to the control to close the first shutoff valve 52 and the second shutoff valve 54 in the air conditioning indoor unit 30 in which the refrigerant is detected. When the refrigerant is detected by the refrigerant detector 56 of any of the air conditioning indoor units 30, the controller 90 may stop the operation of the entire air conditioner 100 by stopping the operation of the compressor 12 of the air conditioning heat source unit 10 in addition to the control to close the first shutoff valve 52 and the second shutoff valve 54 in the air conditioning indoor unit 30 in which the refrigerant is detected.

(3) Features (3-1)

The air conditioning indoor unit 30 according to the above-described embodiments blows air that has exchanged heat with the refrigerant flowing through the utilization heat exchanger 32 into the air conditioning target space R. The utilization heat exchanger 32 is an example of a heat exchanger. The air conditioning indoor unit 30 includes a liquid refrigerant pipe 37*a* and a gas refrigerant pipe 37*b* connected to the utilization heat exchanger 32, a casing 40, a first shutoff valve 52 and a second shutoff valve 54, and a partition wall 60. The casing 40 accommodates the utilization heat exchanger 32. An opening communicating with the air conditioning target space R is formed in the casing 40. The opening includes a suction port 46*a* and a suction opening 481 for sucking air into the casing 40. The opening includes a blow-out port 46*b* and a blow-out opening 482 through which air is blown out of the casing 40. The first shutoff valve 52 and the second shutoff valve 54 are disposed in the first space S1 in the casing 40. The first shutoff valve 52 is disposed in the liquid refrigerant pipe 37*a*. The second shutoff valve 54 is disposed in the gas refrigerant pipe 37*b*. The partition wall 60 separates the first space S1 and the second space S2. The second space S2 is a space in the casing 40 and communicates with the air conditioning target space R via an opening.

In the air conditioning indoor unit 30, the first shutoff valve 52 and the second shutoff valve 54 are disposed in the casing 40 of the air conditioning indoor unit 30. Therefore, the amount of work for installing the air conditioner 100 on site can be reduced, as compared with the case where providing the shutoff valves to the refrigerant connection pipes LP and GP laid on site during the air conditioning heat source unit 10 and the air conditioning indoor unit 30 are connected.

In the air conditioning indoor unit 30, the first shutoff valve 52 and the second shutoff valve 54 are disposed in the first space S1 separated from the second space S2 communicating with the air conditioning target space R by the partition wall 60. In other words, the first shutoff valve 52 and the second shutoff valve 54 are disposed in the first space S1 where the flow of air to the air conditioning target space R is suppressed. Therefore, in the air conditioning indoor unit 30, even if the refrigerant leaks around the first shutoff valve 52 and the second shutoff valve 54, the outflow of the refrigerant into the air conditioning target space R can be suppressed. Therefore, safety is high even when a flammable refrigerant is used.

In the air conditioning indoor unit 30, the first shutoff valve 52 and the second shutoff valve 54 are disposed in the casing 40 of the air conditioning indoor unit 30. Therefore, the amount of the refrigerant flowing out of the refrigerant leaking location when the leakage of refrigerant occurs in the air conditioning indoor unit 30 can be reduced as compared with the case where the shutoff valve is installed at a position of the connection pipes LP and GP distant from the air conditioning indoor unit 30. The reason why the amount of the refrigerant flowing out of the refrigerant leaking location may increase when the shutoff valve is installed at a position in the connection pipes LP and GP distant from the air conditioning indoor unit 30 is that the refrigerant in the connection pipes LP and GP between the shutoff valve and the air conditioning indoor unit 30 may also flow out of the refrigerant leaking location of the air conditioning indoor unit 30.

Further, when the air conditioning indoor unit 30 is used, it is not necessary to secure a space for installing the shutoff valve outside the casing 40 of the air conditioning indoor unit 30, and construction is easy.

(3-2)

In the air conditioning indoor unit 30 according to the above-described embodiments, the first space S1 communicates with the attic space CS.

Therefore, even if the refrigerant leaks around the first shutoff valve 52 and the second shutoff valve 54, the refrigerant flows into the attic space CS that does not directly communicate with the air conditioning target space R. Accordingly, the air conditioning indoor unit 30 suppresses inflow of the refrigerant into the air conditioning target space R and thus achieves high safety.

(3-3)

In the air conditioner 100 of the above-described embodiments, the first shutoff valve 52 and the second shutoff valve 54 are disposed inside the casing 40 of the air conditioning indoor unit 30. Therefore, the amount of work for installing the air conditioner 100 on site can be reduced as compared with the case where providing the shutoff valves to the refrigerant connection pipes LP and GP laid on site during the air conditioning heat source unit 10 and the air conditioning indoor unit 30 are connected.

(4) Modifications

The above-mentioned embodiments may be appropriately modified as described in the following modifications. Each modification may be applied in combination with another modification as long as no contradiction occurs.

(4-1) Modification 1A

The first shutoff valve 52 and the second shutoff valve 54 of the above-described embodiments are dedicated valves for preventing refrigerant leakage. However, valves used for purposes other than the purpose of preventing refrigerant leakage may be used as the first shutoff valve 52 and the second shutoff valve 54 for preventing refrigerant leakage.

Figure 6:
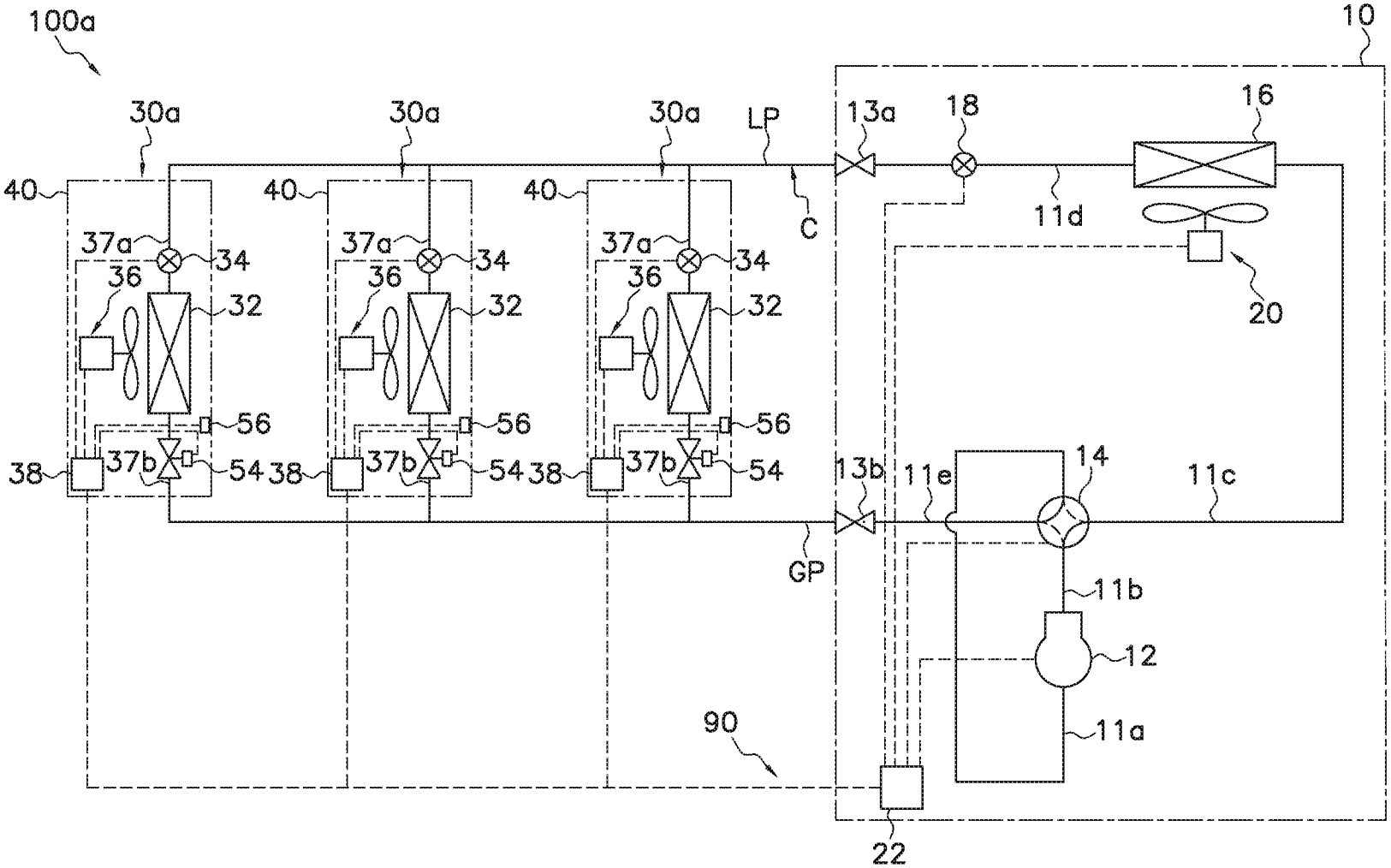
FIG. 6 is a schematic configuration diagram of an air conditioner including an air conditioning indoor unit according to Modification 1A.

For example, like the air conditioning indoor unit 30*a* in FIG. 6, the first shutoff valve 52 of the above-described embodiments may be omitted, and the electronic expansion valve as the second expansion valve 34 disposed in the first space S1 may also be used as the first shutoff valve. Specifically, when the refrigerant detector 56 of any of the air conditioning indoor units 30 detects the leakage of refrigerant, the controller 90 may control to close (fully close) the second expansion valve 34 as the first shutoff valve and the second shutoff valve 54 of that air conditioning indoor unit 30.

The air conditioner 100*a* illustrated in FIG. 6 is similar to the air conditioner 100 of the above-described embodiments except that the second expansion valve 34 is also used as the first shutoff valve, and thus detailed description thereof is omitted.

(4-2) Modification 1B

In the above-described embodiments, the first space S1 communicates with the attic space CS. Alternatively, the first space S1 may communicate with a space other than the attic space CS that does not directly communicate with the air conditioning target space R. For example, the first space S1 may communicate with a space under the floor, a pipe space, or the like that does not communicate with the air conditioning target space R. When the refrigerant is flammable, the space communicating with the first space S1 may be a space without an ignition source.

(4-3) Modification 1C

In the above-described embodiments, the ceiling cassette-type air conditioning indoor unit 30 in which a part (decorative plate 46) of the casing 40 is exposed to the interior is described as a specific example of the air conditioning indoor unit of the present disclosure. However, the type of the air conditioning indoor unit 30 is not limited to the ceiling cassette type. The air conditioning indoor unit of the present disclosure may be, for example, a duct connection-type air conditioning indoor unit, which is one of embedded ceiling types and in which the entire air conditioning indoor unit is disposed in the attic space CS and a duct communicating with the air conditioning target space R is connected to the air conditioning indoor unit.

Figure 7:
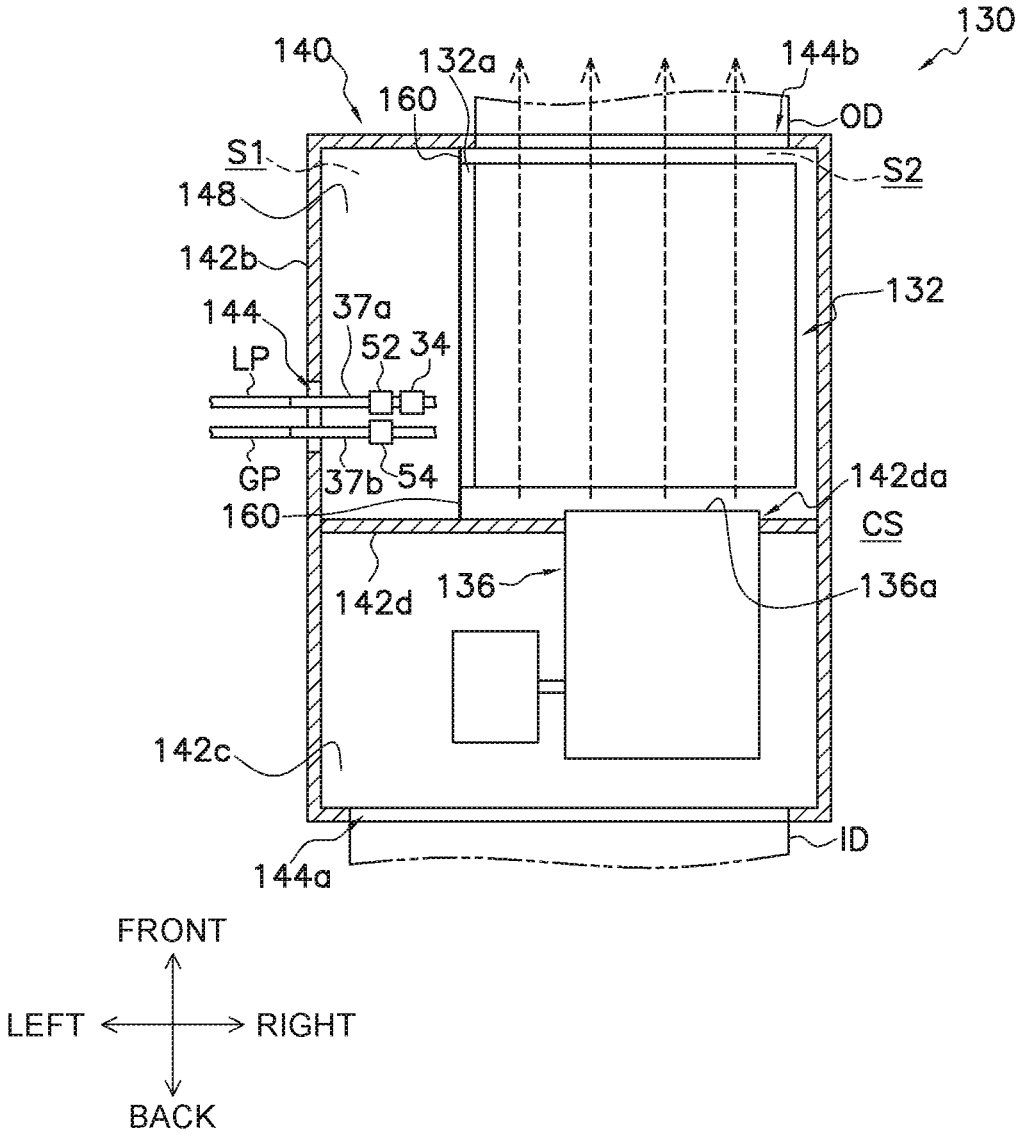
FIG. 7 is a schematic plan view for explaining an arrangement of devices inside an air conditioning indoor unit according to Modification 1C, in which a top panel of a casing is not shown.

A specific example of the duct connection-type air conditioning indoor unit 130 in which the first shutoff valve 52 and the second shutoff valve 54 are disposed in the first space S1 will be described with reference to FIG. 7. FIG. 7 is a schematic plan view for explaining an internal structure and device arrangement of the air conditioning indoor unit 130. In FIG. 7, the top panel of the casing 140 of the air conditioning indoor unit 130 is not shown.

The utilization heat exchanger 132, the second fan 136, the second expansion valve 34, the first shutoff valve 52, and the second shutoff valve 54 of the air conditioning indoor unit 130 are functionally identical to the utilization heat exchanger 32, the second fan 36, the second expansion valve 34, the first shutoff valve 52, and the second shutoff valve 54 of the above-described embodiments, respectively. Therefore, detailed description of the utilization heat exchanger 132, the second fan 136, the second expansion valve 34, the first shutoff valve 52, and the second shutoff valve 54 is omitted unless otherwise necessary in the description of the present disclosure.

As illustrated in FIG. 7, the air conditioning indoor unit 130 includes a casing 140 that accommodates the utilization heat exchanger 132, the second fan 136, the second expansion valve 34, the first shutoff valve 52, and the second shutoff valve 54. In the air conditioning indoor unit 130, the entire casing 140 is disposed in the attic space CS. In other words, the casing 140 is disposed at a position normally invisible from the air conditioning target space R.

The casing 140 mainly includes a top panel (not shown), a side wall 142*b*, a bottom plate 142*c*, a partition plate 142*d*, and a first member 148.

Although the material is not limited, the top panel, the side wall 142*b*, the bottom plate 142*c*, and the partition plate 142*d* of the casing 140 are made of sheet metal, for example. Although the material is not limited, the first member 148 of the casing 140 is made of, for example, styrene foam.

The top panel of the casing 140 is a member constituting a top surface portion of the casing 140. The top panel of the casing 140 has a substantially quadrangular shape in a plan view.

The side wall 142*b* is a member constituting a side surface portion of the casing 140. The side wall 142*b* extends downward from the top panel of the casing 140. The side wall 142*b* has a substantially quadrangular shape corresponding to the shape of the casing 140.

The side wall 142*b* is provided with an opening 144 through which the liquid refrigerant pipe 37*a* and the gas refrigerant pipe 37*b* connected to the utilization heat exchanger 132 are inserted. In FIG. 7, an opening 144 through which the liquid refrigerant pipe 37*a* and the gas refrigerant pipe 37*b* connected to the utilization heat exchanger 132 are inserted is formed in the side wall 142*b* disposed on the left side of the casing 140 (see FIG. 7). The liquid-refrigerant connection pipe LP is connected to an end of the liquid refrigerant pipe 37*a* disposed outside the casing 140. The gas-refrigerant connection pipe GP is connected to an end of the gas refrigerant pipe 37*b* disposed outside the casing 140. The connection between the liquid refrigerant pipe 37*a* and the liquid-refrigerant connection pipe LP and the connection between the gas refrigerant pipe 37*b* and the gas-refrigerant connection pipe GP are the same as those in the above-described embodiments, and thus the description thereof will be omitted.

A suction opening 144*a* to which a suction duct ID for taking in air from air conditioning target space R is connected is formed in the side wall 142*b* disposed on the rear side of the casing 140. The side wall 142*b* disposed on the front side of the casing 140 is provided with a blow-out opening 144*b* to which a blow-out duct OD that supplies air to the air conditioning target space R is connected. The space inside the casing 140 and the attic space CS do not communicate with each other through the suction opening 144*a* or the blow-out opening 144*b*. In other words, the air in the space in the attic space CS does not substantially flow into the casing 140 from the suction opening 144*a* or the blow-out opening 144*b*.

The bottom plate 142*c* of the casing 140 is a member constituting a bottom surface portion of the casing 140. In a plan view, the bottom plate 142*c* of the casing 140 has a substantially quadrangular shape.

The partition plate 142*d* of the casing 140 is a member that partitions the inside of the casing 140 into a fan chamber in which the second fan 136 is mainly disposed and a heat exchange chamber in which the utilization heat exchanger 132 is mainly disposed. The partition plate 142*d* prevents air from flowing between a fan chamber (a space on the rear side of the partition plate 142*d* in FIG. 7) and a heat exchange chamber (a space on the front side of the partition plate 142*d* in FIG. 7). However, the partition plate 142*d* is formed with an opening 142*da* through which a blow-out portion 136*a* of the second fan 136 is inserted in order to dispose the blow-out portion 136*a* of the second fan 136 in the heat exchange chamber. When the second fan 136 is operated, the air sucked from the air conditioning target space R through the suction duct ID and the suction opening 144*a* is blown out from the blow-out portion 136*a* of the second fan 136 toward the utilization heat exchanger 132. In other words, the air in the fan chamber does not directly flow into the heat exchange chamber, but flows into the heat exchange chamber via the second fan 136. The air blown out of the second fan 136 exchanges heat with the refrigerant flowing through the utilization heat exchanger 132, and blows out into the air conditioning target space R through the blow-out opening 144*b* and the blow-out duct OD (see arrows in FIG. 7).

The first member 148 is a member disposed in a space on the front side of the partition plate 142*d* in the casing 140, above the bottom plate 142*c* of the casing 140, and below the utilization heat exchanger 132. In a portion of the first member 148 disposed below the utilization heat exchanger 132, a recess (not shown) is formed so as to be recessed downward to receive condensed water generated in the utilization heat exchanger 132. The recess of the first member 148 disposed below the utilization heat exchanger 132 functions as a drain pan.

As illustrated in FIG. 7, the first space S1 is formed on the left side of the utilization heat exchanger 132. The first space S1 is separated from the second space S2 by a partition wall 160. The second space S2 herein communicates with the air conditioning target space R via the suction opening 144*a* and the blow-out opening 144*b*. The second space S2 includes a flow path of air through which air flows from the blow-out portion 136*a* of the second fan 136 to the blow-out opening 144*b* via the utilization heat exchanger 32 during operation of the second fan 136. The presence of the partition wall 160 suppresses the flow of air between the first space S1 and the second space S2. Therefore, even if the refrigerant leaks in the first space S1, the inflow of the refrigerant from the first space S1 to the second space S2 is suppressed. Furthermore, even if the refrigerant leaks in the first space S1, the inflow of the refrigerant from the first space S1 to the air conditioning target space R via the second space S2 is suppressed.

The air may not flow between the first space S1 and the second space S2. Here, "air may not flow between the first space S1 and the second space S2" means that there is substantially no air flow, and the first space S1 and the second space S2 may not be sealed in an airtight state.

The first space S1 is a space formed such that the upper side is surrounded by a top panel (not shown) of the casing 140, the lateral sides are surrounded by the side wall 142*b*, the partition wall 160, and the partition plate 142*d* of the casing 140, and the lower side is surrounded by the first member 148.

The partition wall 160 is a plate-like member here. The partition wall 160 is attached to, for example, a tube plate 132*a* disposed at the left end of the utilization heat exchanger 132, but the attachment location is not limited. The tube plate 132*a* is a member for fixing a plurality of heat transfer tubes (not shown) of the utilization heat exchanger 132. The partition wall 160 extends from the side wall 142*b* on the front side of the casing 140 to the partition plate 142*d* in the front-rear direction. The partition wall 160 extends vertically from the top panel of the casing 140 to the first member 148. The partition wall 160 may come into contact with the side wall 142*b* on the front side of the casing 140, the partition plate 142*d*, the top panel of the casing 140, and the first member 148 directly or indirectly via another member. Since the partition wall 160 and these members are in direct or indirect contact with each other, the flow of air between the first space S1 and the second space S2 is easily suppressed.

An opening 144 through which the liquid refrigerant pipe 37*a* and the gas refrigerant pipe 37*b* pass is formed in the side wall 142*b* of the casing 140 that forms the first space S1, in other words, that surrounds the first space S1. The first space S1 and the attic space CS in which the casing 140 is installed communicate with each other via the opening 144. The first space S1 and the attic space CS may communicate with each other via the opening 144, but gaps between the liquid refrigerant pipe 37*a* and the gas refrigerant pipe 37*b* and the opening 144 may be closed by a sealing material or the like.

The second expansion valve 34, the first shutoff valve 52, and the second shutoff valve 54 are disposed in the first space S1 formed in this manner. The second expansion valve 34, the first shutoff valve 52, and the second shutoff valve 54 are disposed, for example, at a lower part of the first space S1. However, the present disclosure is not limited to this, and the position in which the second expansion valve 34, the first shutoff valve 52, and the second shutoff valve 54 are disposed in the first space S1 may be appropriately determined. Further, the position of the first space S1 described here is an example, and the first space S1 may be formed at another place.

Second Embodiments

(1) Overall Outline

Figure 8:
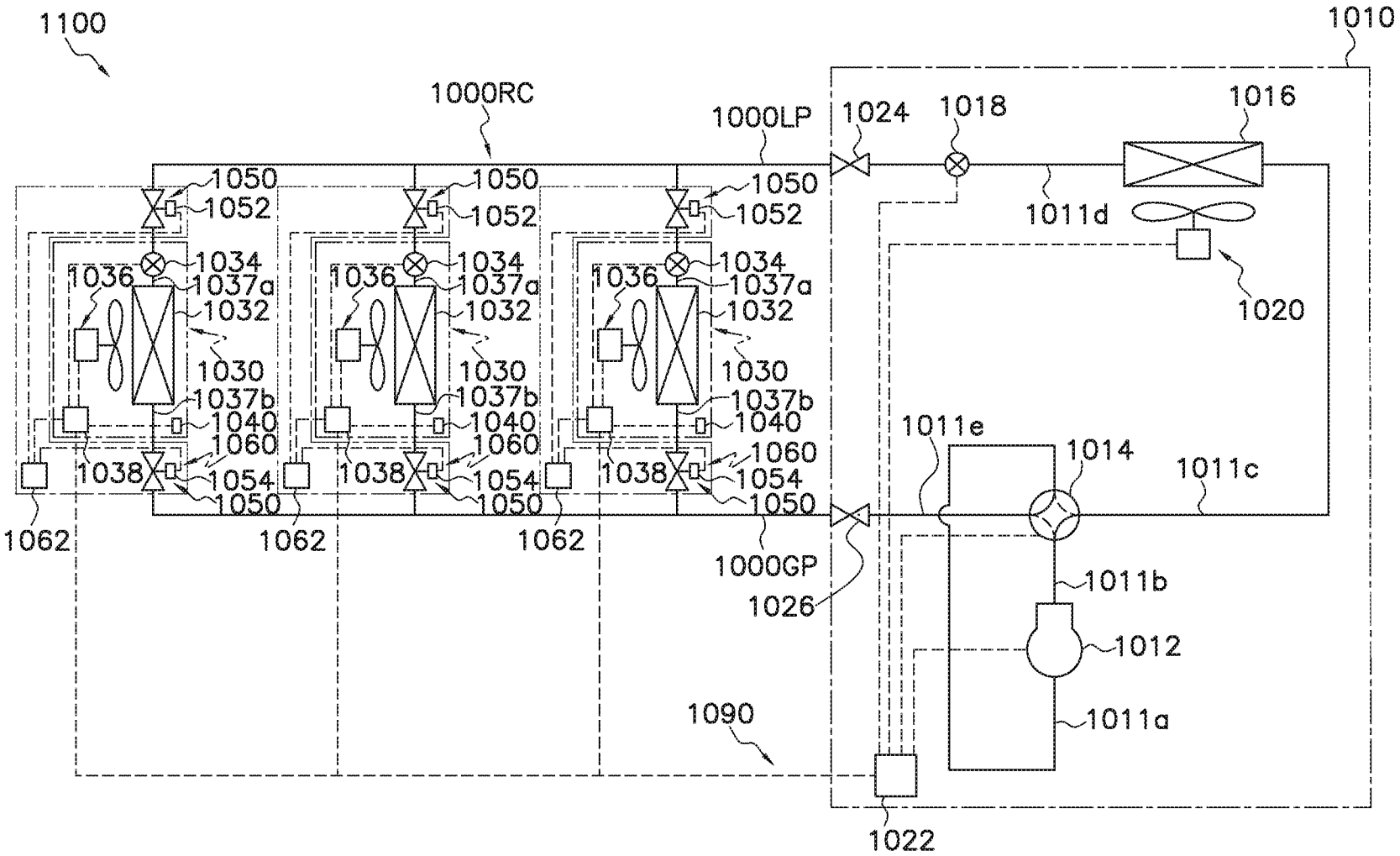
FIG. 8 is a schematic configuration diagram of an air conditioner according to one or more embodiments.
Figure 9:
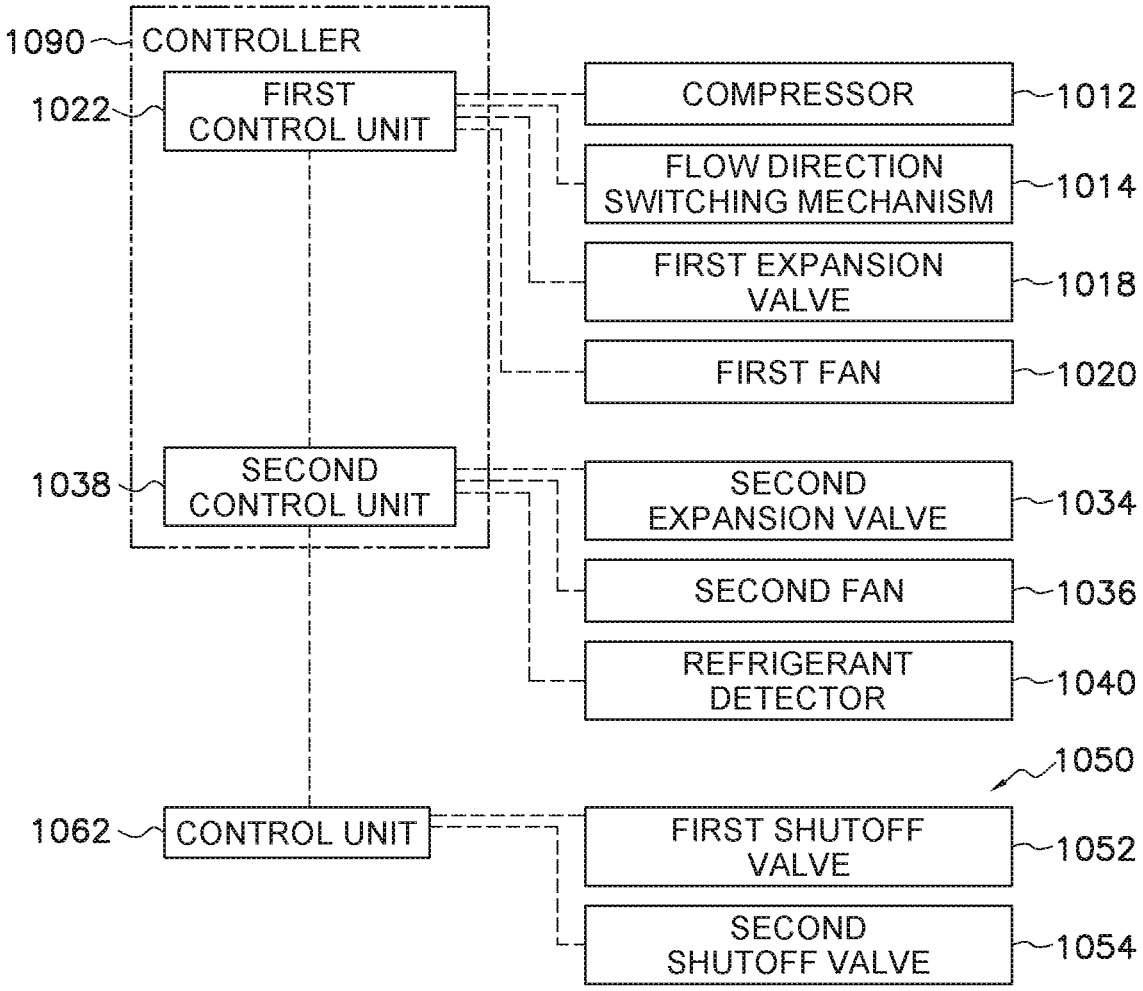
FIG. 9 is a control block diagram of the air conditioner of FIG. 8.

An outline of an air conditioner 1100 according to one or more embodiments will be described with reference to FIGS. 8 and 9. FIG. 8 is a schematic configuration diagram of the air conditioner 1100. FIG. 9 is a control block diagram of the air conditioner 1100. As described later, in one or more embodiments, the air conditioner 1100 includes a plurality of utilization units 1030 each having a second control unit 1038 and a plurality of shutoff valve devices 1060 each having a control unit 1062. However, in FIG. 9, only one second control unit 1038 and one control unit 1062 are illustrated in order to avoid complication of the drawing.

The air conditioner 1100 performs a vapor compression refrigeration cycle to cool or heat the air conditioning target space 1000R. The air conditioning target space 1000R is, for example, a living room of an office or a house. In one or more embodiments, the air conditioner 1100 is capable of both cooling and heating the air conditioning target space 1000R. However, the air conditioner of the present disclosure is not limited to an air conditioner capable of both cooling and heating, and may be, for example, a device capable of only cooling.

The air conditioner 1100 mainly includes a heat source unit 1010 as an example of an air conditioning heat source unit, a utilization unit 1030 as an example of an air conditioning indoor unit, a gas-refrigerant connection pipe 1000GP, a liquid-refrigerant connection pipe 1000LP, and a shutoff valve device 1060.

In one or more embodiments, the air conditioner 1100 includes one heat source unit 1010. However, the number of heat source units 1010 is not limited to one, and the air conditioner 1100 may include a plurality of heat source units 1010.

In one or more embodiments, the air conditioner 1100 includes three utilization units 1030. However, the number of the utilization units 1030 is not limited to plural, and the air conditioner 1100 may include only one utilization unit 1030. The air conditioner 1100 may include two or four or more utilization units 1030.

The gas-refrigerant connection pipe 1000GP and the liquid-refrigerant connection pipe 1000LP connect the heat source unit 1010 and the utilization unit 1030. The gas-refrigerant connection pipe 1000GP and the liquid-refrigerant connection pipe 1000LP are laid at an installation site of the air conditioner 1100. The pipe diameters and pipe lengths of the gas-refrigerant connection pipe 1000GP and the liquid-refrigerant connection pipe 1000LP are selected according to design specifications and installation environments. In the air conditioner 1100, the heat source unit 1010 and the utilization unit 1030 are connected by the gas-refrigerant connection pipe 1000GP and the liquid-refrigerant connection pipe 1000LP to form the refrigerant circuit 1000RC. The refrigerant circuit 1000RC includes a compressor 1012, a heat-source heat exchanger 1016, and a first expansion valve 1018 of the heat source unit 1010 to be described later, and a utilization heat exchanger 1032 and a second expansion valve 1034 of each utilization unit 1030 to be described later. The refrigerant circuit 1000RC includes a first shutoff valve 1052 and a second shutoff valve 1054 of each shutoff valve device 1060 described later.

The refrigerant circuit 1000RC is filled with a refrigerant. Although not limited, the refrigerant sealed in the refrigerant circuit 1000RC is flammable. Examples of the flammable refrigerant include refrigerants categorized in Class 3 (higher flammability), Class 2 (lower flammability), and Subclass 2L (slight flammability) in the standards according to ASHRAE 34 Designation and safety classification of refrigerant in the U.S.A. or the standards according to ISO 817 Refrigerants—Designation and safety classification. Examples of the refrigerant to be used herein may include, but not limited to, R1234yf, R1234ze(E), R516A, R445A, R444A, R454C, R444B, R454A, R455A, R457A, R459B, R452B, R454B, R447B, R32, R447A, R446A, and R459A. One or more embodiments adopt R32 as the refrigerant used therein. The air conditioner of the present disclosure is also useful when the refrigerant is not flammable.

In one or more embodiments, the air conditioner 1100 includes three shutoff valve devices 1060. Each shutoff valve device 1060 is provided corresponding to one of the utilization units 1030.

Each shutoff valve device 1060 includes a shutoff valve 1050 (i.e., shutoff valve group). The shutoff valve 1050 includes at least one of a first shutoff valve disposed in the liquid-refrigerant connection pipe 1000LP and a second shutoff valve disposed in the gas-refrigerant connection pipe 1000GP. In one or more embodiments, the shutoff valve 1050 of each shutoff valve device 1060 includes both the first shutoff valve 1052 disposed in the liquid-refrigerant connection pipe 1000LP and the second shutoff valve 1054 disposed in the gas-refrigerant connection pipe 1000GP.

When closed, the first shutoff valve 1052 of each shutoff valve device 1060 shuts off the flow of the refrigerant flowing from the heat source unit 1010 or from the portion of the liquid-refrigerant connection pipe 1000LP connecting the heat source unit 1010 and the first shutoff valve 1052 to the utilization unit 1030 corresponding to the shutoff valve device 1060 through the first shutoff valve 1052.

When closed, the second shutoff valve 1054 of each shutoff valve device 1060 shuts off the flow of the refrigerant flowing from the heat source unit 1010 or from the portion of the gas-refrigerant connection pipe 1000GP connecting the heat source unit 1010 and the second shutoff valve 1054 to the utilization unit 1030 corresponding to the shutoff valve device 1060 through the second shutoff valve 1054.

(2) Detailed Configuration

The heat source unit 1010, the utilization unit 1030, and the shutoff valve device 1060 will be described in detail.

(2-1) Heat Source Unit

The heat source unit 1010 will be described with reference to FIGS. 8 and 9.

The heat source unit 1010 is installed, for example, on a rooftop of a building in which the air conditioner 1100 is installed, in a machine room of the building, or around the building or the like. In the heat source unit 1010, heat is exchanged between the heat source and the refrigerant in a heat-source heat exchanger 1016 described later. In one or more embodiments, air is used as the heat source, but the present disclosure is not limited thereto, and liquid such as water may be used as the heat source.

The heat source unit 1010 mainly includes a compressor 1012, a flow direction switching mechanism 1014, a heat-source heat exchanger 1016, a first expansion valve 1018, a first fan 1020, a first stop valve 1024, a second stop valve 1026, and a first control unit 1022 (see FIGS. 8 and 9). The configuration of the heat source unit 1010 is merely an example. The heat source unit 1010 may not have a part of the illustrated configuration or may have a configuration other than the illustrated configuration as long as the air conditioner 1100 can function.

The heat source unit 1010 includes, as refrigerant pipes, a suction pipe 1011*a*, a discharge pipe 1011*b*, a first gas refrigerant pipe 1011*c*, a liquid refrigerant pipe 1011*d*, and a second gas refrigerant pipe 1011*e* (see FIG. 8). The suction pipe 1011*a* connects the flow direction switching mechanism 1014 and the suction side of the compressor 1012. The discharge pipe 1011*b* connects the discharge side of the compressor 1012 and the flow direction switching mechanism 1014. The first gas refrigerant pipe 1011*c* connects the flow direction switching mechanism 1014 and the gas side end of the heat-source heat exchanger 1016. The liquid refrigerant pipe 1011*d* connects the liquid side end of the heat-source heat exchanger 1016 and the liquid-refrigerant connection pipe 1000LP. A first stop valve 1024 is provided at a connection portion between the liquid refrigerant pipe 1011*d* and the liquid-refrigerant connection pipe 1000LP. The first expansion valve 1018 is provided between the heat-source heat exchanger 1016 and the first stop valve 1024 of the liquid refrigerant pipe 1011*d*. The second gas refrigerant pipe 1011*e* connects the flow direction switching mechanism 1014 and the gas-refrigerant connection pipe 1000GP. A second stop valve 1026 is provided at a connection portion between the second gas refrigerant pipe 1011*e* and the gas-refrigerant connection pipe 1000GP.

(2-1-1) Compressor

The compressor 1012 sucks and compresses a low-pressure gas refrigerant in the refrigeration cycle and discharges a high-pressure gas refrigerant in the refrigeration cycle. The compressor 1012 is, for example, an inverter control-type compressor. However, the compressor 1012 may be a constant-speed compressor.

(2-1-2) Flow Direction Switching Mechanism

The flow direction switching mechanism 1014 is a mechanism that switches the flow direction of the refrigerant in the refrigerant circuit 1000RC according to the operation mode (cooling operation mode/heating operation mode) of the air conditioner 1100. The flow direction switching mechanism 1014 is a four-way switching valve.

In the cooling operation mode, the flow direction switching mechanism 1014 switches the flow direction of the refrigerant in the refrigerant circuit 1000RC such that the refrigerant discharged from the compressor 1012 is sent to the heat-source heat exchanger 1016. Specifically, in the cooling operation mode, the flow direction switching mechanism 1014 causes the suction pipe 1011*a* to communicate with the second gas refrigerant pipe 1011*e* and causes the discharge pipe 1011*b* to communicate with the first gas refrigerant pipe 1011*c* (see the solid line in FIG. 8). In the cooling operation mode, the heat-source heat exchanger 1016 functions as a condenser, and the utilization heat exchanger 1032 functions as an evaporator.

In the heating operation mode, the flow direction switching mechanism 1014 switches the flow direction of the refrigerant in the refrigerant circuit 1000RC such that the refrigerant discharged from the compressor 1012 is sent to the use heat exchanger 1032. Specifically, in the heating operation mode, the flow direction switching mechanism 1014 causes the suction pipe 1011*a* to communicate with the first gas refrigerant pipe 1011*c* and causes the discharge pipe 1011*b* to communicate with the second gas refrigerant pipe 1011*e* (see a broken line in FIG. 8). In the heating operation mode, the heat-source heat exchanger 1016 functions as an evaporator, and the utilization heat exchanger 1032 functions as a condenser.

The flow direction switching mechanism 1014 may be realized without using a four-way switching valve. For example, the flow direction switching mechanism 1014 may be configured by combining a plurality of electromagnetic valves and pipes so as to realize switching of the refrigerant flow direction as described above.

(2-1-3) Heat-Source Heat Exchanger

In the heat-source heat exchanger 1016, heat is exchanged between the refrigerant flowing through the heat-source heat exchanger 1016 and air as a heat source. The heat-source heat exchanger 1016 functions as a condenser (radiator) of the refrigerant during the cooling operation, and functions as an evaporator of the refrigerant during the heating operation. Although not limited, the heat-source heat exchanger 1016 is, for example, a fin-and-tube heat exchanger having a plurality of heat transfer tubes and a plurality of heat transfer fins.

(2-1-4) First Expansion Valve

The first expansion valve 1018 is a mechanism that decompresses the refrigerant and adjusts the flow rate of the refrigerant. In one or more embodiments, the first expansion valve 1018 is an electronic expansion valve whose opening degree is adjustable. The opening degree of the first expansion valve 1018 is appropriately adjusted according to the operation situation. The first expansion valve 1018 is not limited to the electronic expansion valve, and may be another type of valve such as an automatic temperature expansion valve.

(2-1-5) First Fan

The first fan 1020 is a blower that generates an air flow that flows into the heat source unit 1010 from the outside of the heat source unit 1010, passes through the heat-source heat exchanger 1016, and then flows out of the heat source unit 1010. The first fan 1020 is, for example, an inverter control-type fan. However, the first fan 1020 may be a constant-speed fan.

(2-1-6) First Stop Valve and Second Stop Valve

The first stop valve 1024 is a valve provided at a connection portion between the liquid refrigerant pipe 1011*d* and the liquid-refrigerant connection pipe 1000LP. The second stop valve 1026 is a valve provided at a connection portion between the second gas refrigerant pipe 1011*e* and the gas-refrigerant connection pipe 1000GP. The first stop valve 1024 and the second stop valve 1026 are manual valves. The first stop valve 1024 and the second stop valve 1026 are opened when the air conditioner 1100 is used.

(2-1-7) First Control Unit

The first control unit 1022 controls operations of various devices of the heat source unit 1010. The first control unit 1022 mainly includes a microcontroller unit (MCU), various electric circuits, and electronic circuits (not shown). The MCU includes a CPU, a memory, an I/O interface, and the like. The memory of the MCU stores various programs to be executed by the CPU of the MCU. Note that the various functions of the first control unit 1022 need not be implemented by software, and may be implemented by hardware or may be implemented by cooperation of hardware and software.

The first control unit 1022 is electrically connected to various devices of the heat source unit 1010 including the compressor 1012, the flow direction switching mechanism 1014, the first expansion valve 1018, and the first fan 1020 (see FIG. 9). The first control unit 1022 is electrically connected to various sensors (not shown) provided in the heat source unit 1010. Although not limited, the sensor provided in the heat source unit 1010 includes a temperature sensor and a pressure sensor provided in the discharge pipe 1011*b* and the suction pipe 1011*a*, a temperature sensor provided in the heat-source heat exchanger 1016 and the liquid refrigerant pipe 1011*d*, a temperature sensor that measures the temperature of the heat source air, and the like. The heat source unit 1010 may include all or some of these sensors.

As illustrated in FIG. 9, the first control unit 1022 is connected to the second control unit 1038 of the utilization unit 1030 via a communication line. The first control unit 1022 and the second control unit 1038 exchange various signals via a communication line. The first control unit 1022 and the second control unit 1038 cooperate to function as a controller 1090 that controls the operation of the air conditioner 1100. The function of the controller 1090 will be described later.

(2-2) Utilization Unit

The utilization unit 1030 will be described. In the utilization unit 1030, heat is exchanged between the refrigerant and the air in the air conditioning target space 1000R in the utilization heat exchanger 1032 described later, and as a result, cooling or heating of the air conditioning target space 1000R is performed.

In one or more embodiments, the air conditioner 1100 includes three utilization units 1030. Structures and capabilities of the three utilization units 1030 may be the same or different from each other. Here, the utilization units 1030 will be described as having the same configuration.

Figure 10A:
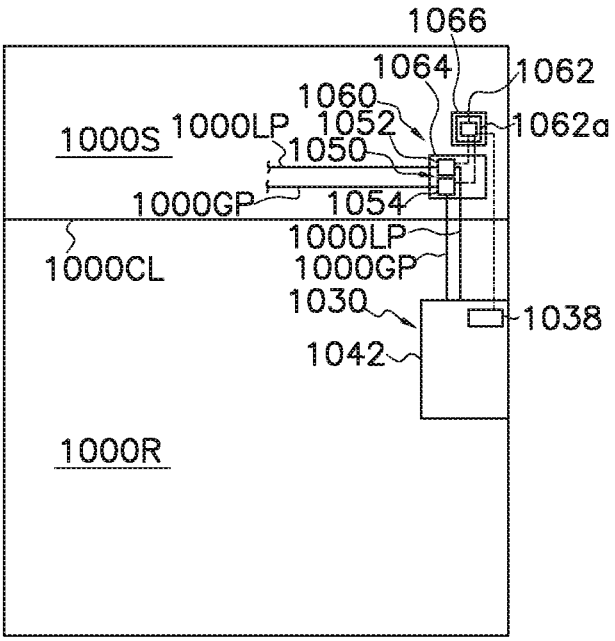
FIG. 10A is a diagram schematically illustrating installation states of a utilization unit and a shutoff valve device in a case where the utilization unit of the air conditioner in FIG. 8 is a wall-mounted type.
Figure 10B:
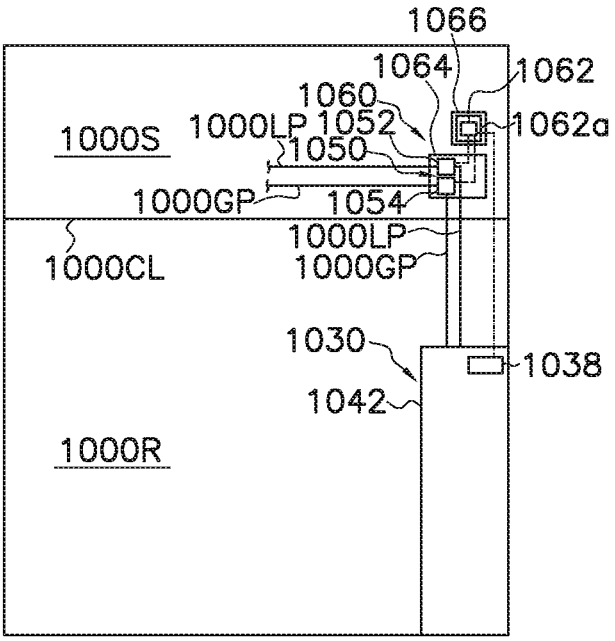
FIG. 10B is a diagram schematically illustrating installation states of the utilization unit and the shutoff valve device in a case where the utilization unit of the air conditioner in FIG. 8 is a floor type.
Figure 10C:
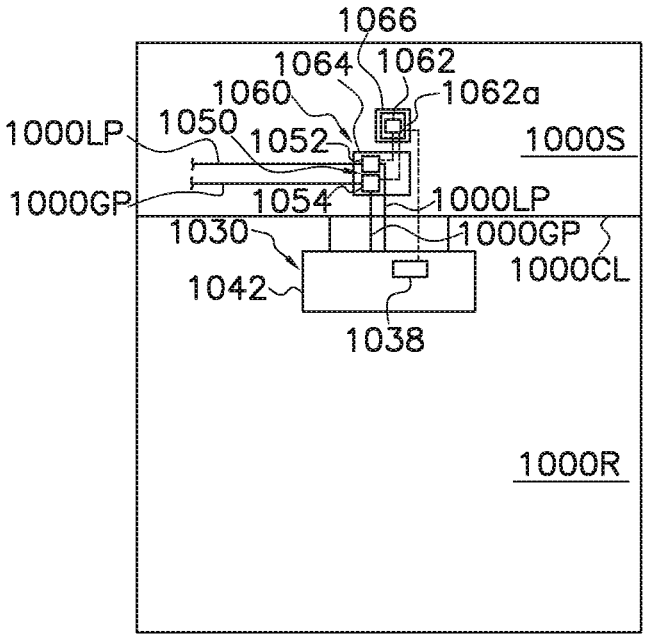
FIG. 10C is a diagram schematically illustrating installation states of the utilization unit and the shutoff valve device in a case where the utilization unit of the air conditioner in FIG. 8 is a ceiling suspended type.

The type of the utilization unit 1030 is, for example, a wall-mounted type as illustrated in FIG. 10A, and is attached to the wall of the air conditioning target space 1000R. The type of the utilization unit 1030 may be, for example, a floor type as illustrated in FIG. 10B, and may be installed on the floor of the air conditioning target space 1000R. The type of the utilization unit 1030 may be, for example, a ceiling suspended type as illustrated in FIG. 10C, and may be installed to be suspended on the ceiling of the air conditioning target space 1000R. The air conditioner 1100 may include two or more types of utilization units 1030.

As shown in FIGS. 8, 9, and 10A to 10C, the utilization unit 1030 mainly includes a casing 1042, a utilization heat exchanger 1032, a second expansion valve 1034, a second fan 1036, a refrigerant detector 1040, and a second control unit 1038. Note that the configuration of the utilization unit 1030 illustrated here is merely an example. The utilization unit 1030 may not have a part of the illustrated configuration or may have a configuration other than the illustrated configuration as long as the air conditioner 1100 can function.

The utilization unit 1030 includes, as refrigerant pipes, a liquid refrigerant pipe 1037*a* and a gas refrigerant pipe 1037*b* connected to the utilization heat exchanger 1032 (see FIG. 8). The liquid refrigerant pipe 1037*a* connects the liquid-refrigerant connection pipe 1000LP and the liquid side of the utilization heat exchanger 1032. The gas refrigerant pipe 1037*b* connects the gas-refrigerant connection pipe 1000GP and the gas side of the utilization heat exchanger 1032. The liquid refrigerant pipe 1037*a* is provided with a second expansion valve 1034.

(2-2-1) Casing

The casing 1042 accommodates therein various devices of the utilization unit 1030 including the utilization heat exchanger 1032, the second expansion valve 1034, and the second fan 1036. The casing 1042 is disposed in the air conditioning target space 1000R as shown in FIGS. 10A to 10C. Unlike a utilization unit of a ceiling-embedded type or the like, a part of the casing 1042 is not arranged in the attic space 1000S.

The casing 1042 is provided with a suction port (not shown) for taking in the air in the air conditioning target space 1000R. The casing 1042 has a blow-out port (not shown) through which air introduced into the casing 1042 through the suction port and having exchanged heat with the refrigerant in the utilization heat exchanger 1032 is blown out into the air conditioning target space 1000R. The shape and structure of the casing 1042 vary depending on the type (wall-mounted type, floor type, ceiling-suspended type) of the utilization unit 1030. Here, description of the shape and structure of the casing 1042 of each type of utilization unit 1030 is omitted.

(2-2-2) Indoor Heat Exchanger

In the utilization heat exchanger 1032, heat is exchanged between the refrigerant flowing through the utilization heat exchanger 1032 and air. The utilization heat exchanger 1032 functions as an evaporator of the refrigerant during the cooling operation, and functions as a condenser (radiator) of the refrigerant during the heating operation. Although not limited, the utilization heat exchanger 1032 is, for example, a fin-and-tube heat exchanger having a plurality of heat transfer tubes and a plurality of heat transfer fins.

(2-2-3) Second Expansion Valve

The second expansion valve 1034 is a mechanism that decompresses the refrigerant and adjusts the flow rate of the refrigerant. In one or more embodiments, the second expansion valve 1034 is an electronic expansion valve whose opening degree is adjustable. The opening degree of the second expansion valve 1034 is appropriately adjusted according to the operation situation. The second expansion valve 1034 is not limited to the electronic expansion valve, and may be another type of valve such as an automatic temperature expansion valve.

(2-2-4) Second Fan

The second fan 1036 is a blower that generates an air flow that flows into the casing 1042 from a suction port (not shown) of the casing 1042, passes through the utilization heat exchanger 1032, and then flows out of the casing 1042 from a blow-out port of the casing 1042. The second fan 1036 is, for example, an inverter control-type fan. However, the second fan 1036 may be a constant-speed fan.

(2-2-5) Refrigerant Detector

The refrigerant detector 1040 is a sensor that detects the leakage of refrigerant at the utilization unit 1030. The refrigerant detector 1040 is provided, for example, in the casing 1042 of the utilization unit 1030. The refrigerant detector 1040 may be disposed outside the casing 1042 of the utilization unit 1030. A plurality of refrigerant detectors 1040 may be provided.

The refrigerant detector 1040 is, for example, a semiconductor-type sensor. The semiconductor refrigerant detector 1040 includes a semiconductor-type detection element (not shown). The semiconductor detector element has electric conductivity that changes depending on whether it is in a case where no refrigerant gas exists therearound and in a case where refrigerant gas exists therearound. When the refrigerant gas exists around the semiconductor-type detection element, the refrigerant detector 1040 outputs a relatively large current as a detection signal. On the other hand, when the refrigerant gas does not exist around the semiconductor-type detection element, the refrigerant detector 1040 outputs a relatively small current as a detection signal.

The type of the refrigerant detector 1040 is not limited to the semiconductor type, and may be any sensor capable of detecting refrigerant gas. For example, the refrigerant detector 1040 may be an infrared sensor that outputs a detection signal according to a detection result of the refrigerant.

(2-2-6) Second Control Unit

The second control unit 1038 controls operations of various devices of the utilization unit 1030. The second control unit 1038 includes a microcontroller unit (MCU), various electric circuits, and electronic circuits (not shown). The MCU includes a CPU, a memory, an I/O interface, and the like. The memory of the MCU stores various programs to be executed by the CPU of the MCU. Note that the various functions of the second control unit 1038 does not need to be implemented by software, and may be implemented by hardware or may be implemented by cooperation of hardware and software.

The second control unit 1038 is electrically connected to various devices of the utilization unit 1030 including the second expansion valve 1034 and the second fan 1036 (see FIG. 9). The second control unit 1038 is electrically connected to the refrigerant detector 1040. The second control unit 1038 is electrically connected to a sensor (not shown) provided in the utilization unit 1030. Although not limited, the sensors (not shown) include a temperature sensor provided in the utilization heat exchanger 1032 and the liquid refrigerant pipe 1037*a*, a temperature sensor that measures the temperature of the air conditioning target space 1000R, and the like. The utilization unit 1030 may include all or some of these sensors.

The second control unit 1038 is communicably connected to the control unit 1062 that controls the operations of the first shutoff valve 1052 and the second shutoff valve 1054 of the shutoff valve device 1060 by a communication line (see FIG. 9).

As illustrated in FIG. 9, the second control unit 1038 is connected to the first control unit 1022 of the heat source unit 1010 via a communication line. The second control unit

1038 is communicably connected to a remote control unit for operating the air conditioner 1100 (not shown) via a communication line. The first control unit 1022 and the second control unit 1038 cooperate to function as a controller 1090 that controls the operation of the air conditioner 1100.

The function of the controller 1090 will be described. Some or all of various functions of the controller 1090 described below may be executed by a control device provided separately from the first control unit 1022 and the second control unit 1038.

The controller 1090 controls the operation of the flow direction switching mechanism 1014 such that the heat-source heat exchanger 1016 functions as a condenser of the refrigerant and the utilization heat exchanger 1032 functions as an evaporator of the refrigerant during the cooling operation. During the heating operation, the controller 1090 controls the operation of the flow direction switching mechanism 1014 such that the heat-source heat exchanger 1016 functions as an evaporator of the refrigerant and the utilization heat exchanger 1032 functions as a condenser of the refrigerant. The controller 1090 operates the compressor 1012, the first fan 1020, and the second fan 1036 during the cooling operation and the heating operation. During the cooling operation and the heating operation, the controller 1090 adjusts the numbers of rotations of the motors of the compressor 1012, the first fan 1020, and the second fan 1036 and the opening degrees of the first expansion valve 1018 and the second expansion valve 1034 based on various instructions (set temperature, set air volume, and the like) input to the remote control unit and measurement values of various temperature sensors and pressure sensors. Various control modes are generally known for the control of the operations of the various devices of the air conditioner 1100 during the cooling operation and the heating operation, and thus, the description thereof will be omitted here.

The control of the air conditioner 1100 by the controller 1090 when the refrigerant is detected by the refrigerant detector 1040 of any of the utilization units 1030 will be described later.

(2-3) Shutoff Valve Device

Each shutoff valve device 1060 is installed corresponding to one of the utilization units 1030. The shutoff valve device 1060 is a device that closes the shutoff valve 1050 included in the shutoff valve device 1060 to suppress the inflow of the refrigerant into the utilization unit 1030 corresponding to the shutoff valve device 1060.

The shutoff valve device 1060 mainly includes a shutoff valve 1050, a main body casing 1064, an electric component 1062*a*, and an electric component box 1066 that accommodates the electric component 1062*a*. The electric component 1062*a* includes a control unit 1062 that controls operations of the first shutoff valve 1052 and the second shutoff valve 1054.

(2-3-1) Shutoff Valve

The shutoff valve 1050 includes at least one of a first shutoff valve disposed in the liquid-refrigerant connection pipe 1000LP and a second shutoff valve disposed in the gas-refrigerant connection pipe 1000GP. In one or more embodiments, the shutoff valve 1050 of each shutoff valve device 1060 includes both the first shutoff valve 1052 disposed in the liquid-refrigerant connection pipe 1000LP and the second shutoff valve 1054 disposed in the gas-refrigerant connection pipe 1000GP.

A liquid-refrigerant connection pipe 1000LP connecting the heat source unit 1010 and the first shutoff valve 1052 is connected to one end of the first shutoff valve 1052 of the shutoff valve device 1060. A liquid-refrigerant connection pipe 1000LP that connects the liquid refrigerant pipe 1037*a* of the utilization unit 1030 corresponding to the shutoff valve device 1060 and the first shutoff valve 1052 is connected to the other end of the first shutoff valve 1052 of the shutoff valve device 1060.

A gas-refrigerant connection pipe 1000GP connecting the heat source unit 1010 and the second shutoff valve 1054 is connected to one end of the second shutoff valve 1054 of the shutoff valve device 1060. A gas-refrigerant connection pipe 1000GP that connects the gas refrigerant pipe 1037*b* of the utilization unit 1030 corresponding to the shutoff valve device 1060 and the second shutoff valve 1054 is connected to the other end of the second shutoff valve 1054 of the shutoff valve device 1060.

The first shutoff valve 1052 and the second shutoff valve 1054 are valves that suppress the leakage of refrigerant into the air conditioning target space 1000R when the leakage of refrigerant occurs at the utilization unit 1030. The first shutoff valve 1052 and the second shutoff valve 1054 are, for example, electromagnetic valves capable of switching between a closed state (fully closed) and an open state (fully open). However, the types of the first shutoff valve 1052 and the second shutoff valve 1054 are not limited to the electromagnetic valve, and may be, for example, an electric valve.

The first shutoff valve 1052 and the second shutoff valve 1054 of the shutoff valve device 1060 are normally opened. The normal time here means a time when the second control unit 1038 of the utilization unit 1030 corresponding to the shutoff valve device 1060 has not transmitted a signal instructing the control unit 1062 to close the shutoff valve 1050.

On the other hand, when the refrigerant detector 1040 of the utilization unit 1030 corresponding to the shutoff valve device 1060 detects the refrigerant, the first shutoff valve 1052 and the second shutoff valve 1054 are closed. Specifically, when the refrigerant detector 1040 of the utilization unit 1030 corresponding to the shutoff valve device 1060 detects the refrigerant and the second control unit 1038 of the corresponding utilization unit 1030 transmits a signal instructing to close the shutoff valve 1050 to the control unit 1062 of the corresponding shutoff valve device 1060, the control unit 1062 that has received the signal performs control to close the first shutoff valve 1052 and the second shutoff valve 1054. When the first shutoff valve 1052 and the second shutoff valve 1054 of the shutoff valve device 1060 are closed, the inflow of the refrigerant from the heat source unit 1010, the pipe connecting the heat source unit 1010 and the first shutoff valve 1052, and the pipe connecting the heat source unit 1010 and the second shutoff valve 1054 to the utilization unit 1030 corresponding to the shutoff valve device 1060 is suppressed.

As illustrated in FIGS. 10A to 10C, the shutoff valve 1050 (the first shutoff valve 1052 and the second shutoff valve 1054) is disposed in the attic space 1000S above the ceiling 1000CL of the air conditioning target space 1000R. The shutoff valve 1050 may be disposed in the attic space 1000S and in the vicinity of the corresponding utilization unit 1030. Although the arrangement is not limited, the shutoff valve 1050 is arranged, for example, in the attic space 1000S and in the vicinity immediately above the corresponding utilization unit 1030.

When the upper floor is present above the air conditioning target space 1000R in the building in which the air conditioner 1100 is installed, the attic space 1000S is a space between the ceiling 1000CL of the air conditioning target space 1000R and the floor of the upper floor (one floor above) of the air conditioning target space 1000R. When the air conditioning target space 1000R is the uppermost floor in the building in which the air conditioner 1100 is installed (when there is no upper floor above the air conditioning target space 1000R), the attic space 1000S is a space between the ceiling 1000CL of the air conditioning target space 1000R and the roof of the building.

The attic space 1000S is a space partitioned from the air conditioning target space 1000R by the building material constituting the ceiling 1000CL. The fact that the attic space 1000S and the air conditioning target space 1000R are partitioned does not mean that both spaces are partitioned in an airtight state, but means that the flow of air between both spaces is at least suppressed by the building material constituting the ceiling 1000CL. For example, some air may flow between the attic space 1000S and the air conditioning target space 1000R via a gap between building materials. The gap between the building materials is not limited, but is, for example, a gap between an inspection port provided in the ceiling 1000CL for inspecting the attic space 1000S and a closing member that closes the inspection port.

In the air conditioner 1100 of one or more embodiments, since the shutoff valve 1050 is installed in the attic space 1000S, even if the refrigerant leaks around the shutoff valve 1050, the refrigerant flows not into the air conditioning target space 1000R but into the attic space 1000S partitioned from the air conditioning target space 1000R. In short, in the air conditioner 1100 according to one or more embodiments, the refrigerant is less likely to flow into the air conditioning target space 1000R where people are active. Therefore, the air conditioner 1100 has high safety even when, for example, a flammable refrigerant is used.

(2-3-2) Main Body Casing

The main body casing 1064 is a casing that accommodates the shutoff valve 1050. Specifically, the main body casing 1064 is a casing that accommodates the first shutoff valve 1052 and the second shutoff valve 1054.

Figure 11A:
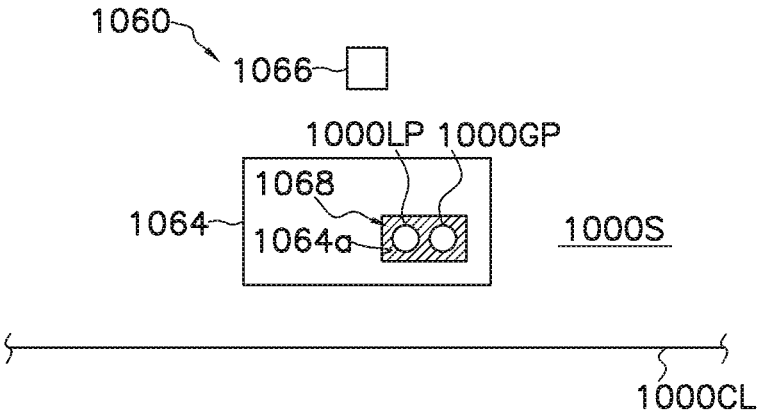
FIG. 11A is a side view schematically illustrating a main body casing and an electric component box of the shutoff valve device.

As illustrated in FIG. 11A, the main body casing 1064 is installed in the attic space 1000S. In order to dispose the shutoff valve 1050 in the vicinity of the corresponding utilization unit 1030, the main body casing 1064 may be installed in the vicinity of the corresponding utilization unit 1030. Although not limited, the main body casing 1064 is installed in the attic space 1000S and in the vicinity immediately above the corresponding utilization unit 1030.

For example, as illustrated in FIG. 11A, the main body casing 1064 is formed with an opening 1064*a* through which a liquid-refrigerant connection pipe 1000LP connected to both ends of the first shutoff valve 1052 and a gas-refrigerant connection pipe 1000GP connected to both ends of the second shutoff valve 1054 are inserted. In FIG. 11A, a part of these openings 1064*a* (for example, an opening 1064*a* through which the liquid-refrigerant connection pipe 1000LP connecting the heat source unit 1010 and the first shutoff valve 1052 and the gas-refrigerant connection pipe 1000GP connecting the heat source unit 1010 and the second shutoff valve 1054 pass) is illustrated. In the example of FIG. 11A, a plurality of refrigerant pipes (one liquid-refrigerant connection pipe 1000LP and one gas-refrigerant connection pipe 1000GP) are arranged to extend through one opening 1064*a*.

Figure 11B:
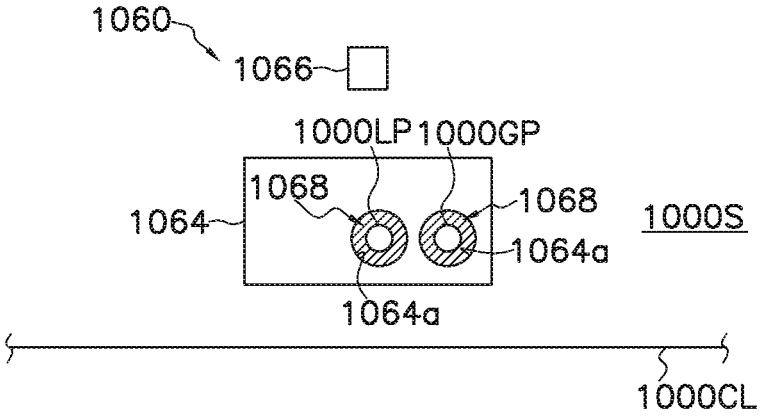
FIG. 11B is a side view schematically illustrating a main body casing and an electric component box of another example of the shutoff valve device.

In place of the openings through which the plurality of refrigerant pipes pass, the main body casing 1064 may include, as shown in FIG. 11B, openings 1064*a* arrange so that one refrigerant pipe (one liquid-refrigerant connection pipe 1000LP or one gas-refrigerant connection pipe 1000GP) extends through each of the opening 1064*a*.

The opening 1064*a* may be provided with a heat insulating material 1068 that closes a gap between the opening 1064*a* and the liquid-refrigerant connection pipe 1000LP, a gap between the opening 1064*a* and the gas-refrigerant connection pipe 1000GP, and a gap between the liquid-refrigerant connection pipe 1000LP and the gas-refrigerant connection pipe 1000GP. By closing the gap between the opening 1064*a* and the connection pipes 1000LP and 1000GP and the gap between the refrigerant pipes with the heat insulating material 1068 in this manner, the leakage of the refrigerant into the attic space 1000S is suppressed even if the refrigerant leaks inside the main body casing 1064, and safety is therefore high.

(2-3-3) Electric Component

The electric component 1062*a* includes various components for operating the first shutoff valve 1052 and the second shutoff valve 1054. Although not limited, the electric component 1062*a* includes, for example, a switching unit capable of switching the flow of current, such as a printed circuit board, an electromagnetic relay, and a switching element, a terminal block to which power is supplied, and an input unit to which a signal from the second control unit 1038 is input. The electric component 1062*a* is electrically connected to the first shutoff valve 1052 and the second shutoff valve 1054 by an electric wire for supplying a drive voltage. At least a part of the electric component 1062*a* functions as the control unit 1062 that closes the first shutoff valve 1052 and the second shutoff valve 1054 in response to a signal requesting closing of the shutoff valve 1050 from the second control unit 1038 of the utilization unit 1030.

The control unit 1062 includes, for example, a microcontroller unit (MCU), various electric circuits, and electronic circuits (not shown). The MCU includes a CPU, a memory, an I/O interface, and the like. The memory of the MCU stores various programs to be executed by the CPU of the MCU. Note that the various functions of the control unit 1062 does not need to be implemented by software, and may be implemented by hardware or may be implemented by cooperation of hardware and software.

The electric component 1062*a* is accommodated in the electric component box 1066. The electric component box 1066 may be disposed outside the main body casing 1064. The electric component box 1066 is installed, for example, in the attic space 1000S. When the electric component box 1066 and the main body casing 1064 have independent configurations, the electric component box 1066 may not be disposed in the vicinity of the main body casing 1064. The installation position of the electric component box 1066 may be appropriately determined.

(3) Control of Air Conditioner by Controller at Time of Refrigerant Detection The control of the air conditioner 1100 by the controller 1090 when the refrigerant is detected by the refrigerant detector 1040 of any of the utilization units 1030 will be described. Here, the case where the refrigerant is detected by the refrigerant detector 1040 means a case where the value of the current output as the detection signal by the refrigerant detector 1040 is larger than a predetermined threshold.

When the refrigerant is detected by the refrigerant detector 1040 of any of the utilization units 1030, the controller 1090 transmits a signal instructing to close the shutoff valve 1050 of the shutoff valve device 1060 to the control unit 1062 of the shutoff valve device 1060 corresponding to the utilization unit 1030 in which the refrigerant is detected. The signal instructing to close the shutoff valve 1050 may be a contact signal. The control unit 1062 of the shutoff valve device 1060 closes the shutoff valve 1050 (in one or more embodiments, the first shutoff valve 1052 and the second shutoff valve 1054) based on this signal.

When the refrigerant is detected by the refrigerant detector 1040 of any of the utilization units 1030, the controller 1090 may notify of the leakage of refrigerant using an alarm (not shown) in addition to transmitting a signal instructing to close the shutoff valve 1050 to the control unit 1062 of the shutoff valve device 1060.

When the refrigerant is detected by the refrigerant detector 1040 of any of the utilization units 1030, the controller 1090 may stop the operation of the entire air conditioner 1100 by stopping the operation of the compressor 1012 and in addition to transmitting a signal instructing to close the shutoff valve 1050 to the control unit 1062 of the shutoff valve device 1060.

When the refrigerant is detected by the refrigerant detector 1040 of any of the utilization units 1030, the controller 1090 may transmit a signal instructing to close the shutoff valve 1050 to the control unit 1062 of the shutoff valve device 1060 corresponding to that utilization unit 1030 and may further transmit a signal instructing to close the shutoff valve 1050 to the control unit 1062 of another shutoff valve device 1060 (for example, all the shutoff valve devices 1060).

(4) Features (4-1)

The air conditioner 1100 of one or more embodiments includes a utilization unit 1030 as an air conditioning indoor unit, a heat source unit 1010 as an air conditioning heat source unit, and a shutoff valve device 1060. The utilization unit 1030 is installed in the air conditioning target space 1000R. The heat source unit 1010 is connected to the utilization unit 1030 via a liquid-refrigerant connection pipe 1000LP and a gas-refrigerant connection pipe 1000GP. The shutoff valve device 1060 includes a shutoff valve 1050 disposed in the attic space 1000S above the ceiling 1000CL of the air conditioning target space 1000R. The shutoff valve 1050 includes at least one of a first shutoff valve 1052 disposed in the liquid-refrigerant connection pipe 1000LP and a second shutoff valve 1054 disposed in the gas-refrigerant connection pipe 1000GP. In one or more embodiments, the shutoff valve 1050 includes both the first shutoff valve 1052 and the second shutoff valve 1054.

As disclosed in Patent Literature 2 (JP 2013-19621 A), there is known an air conditioner in which an air conditioning indoor unit is provided with a shutoff valve for preventing the leakage of refrigerant separately from the air conditioning indoor unit. The shutoff valve is disposed in the vicinity of the air conditioning indoor unit to reduce the amount of refrigerant leaking from the air conditioning indoor unit when the leakage of refrigerant is detected.

However, when the shutoff valve is disposed in the air conditioning target space adjacent to the air conditioning indoor unit disposed in the air conditioning target space, if the refrigerant leaks from the shutoff valve, a relatively large amount of refrigerant may leak into the air conditioning target space.

In the air conditioner 1100, even if the refrigerant leaks around the shutoff valve 1050, the refrigerant flows not into the air conditioning target space 1000R but into the attic space 1000S partitioned from the air conditioning target space 1000R, and thus safety is high.

(4-2)

In the air conditioner 1100 of one or more embodiments, the shutoff valve device 1060 includes a main body casing 1064 as an example of a casing that accommodates the first shutoff valve 1052 and the second shutoff valve 1054.

In the present air conditioner 1100, the shutoff valve device 1060 is a unit in which the first shutoff valve 1052, the second shutoff valve 1054, and the main body casing 1064 accommodating them are unitized. It is therefore easy to incorporate the shutoff valve device 1060 into the air conditioner 1100.

(4-3)

In the air conditioner 1100 of one or more embodiments, the shutoff valve device 1060 includes an electric component box 1066 that accommodates electric components 1062*a* for operating the shutoff valve 1050. The electric component box 1066 is disposed outside the main body casing 1064.

In the present air conditioner 1100, since the electric component box 1066 is disposed outside the main body casing 1064, if the refrigerant is flammable, and the refrigerant leaks around the shutoff valve 1050, it is possible to suppress contact between the refrigerant and the electric component 1062*a* that can be an ignition source.

(4-4)

In the air conditioner 1100 of one or more embodiments, an opening 1064*a* is formed in the main body casing 1064. The liquid-refrigerant connection pipe 1000LP connected to the first shutoff valve 1052 and the gas-refrigerant connection pipe 1000GP connected to the second shutoff valve 1054 extend through the opening 1064*a* of the main body casing 1064. The shutoff valve device 1060 includes a heat insulating material 1068 that closes a gap between the opening 1064*a* and the liquid-refrigerant connection pipe 1000LP and a gap between the opening 1064*a* and the gas-refrigerant connection pipe 1000GP.

In the present air conditioner 1100, since the gap between the opening 1064*a* and the refrigerant connection pipes 1000LP and 1000GP extending through the opening 1064*a* is closed by the heat insulating material 1068, the leakage of refrigerant into the attic space 1000S is suppressed even if the refrigerant leaks inside the main body casing 1064, and safety is high.

(5) Modifications

The above described embodiments may be appropriately modified as described in the following modifications. Some or all of the modifications may be combined with the above-described embodiments or another modification as long as no contradiction occurs.

(5-1) Modification 2A

In the above-described embodiments, the control unit 1062 of the shutoff valve device 1060 controls the operation of the shutoff valve 1050, but the present disclosure is not limited to such a configuration. For example, the shutoff valve device 1060 may not include the control unit 1062, and the controller 1090 of the air conditioner 1100, more specifically, the second control unit 1038 of the utilization unit 1030, for example, may control the operation of the shutoff valve 1050.

(5-2) Modification 2B

In the above-described embodiments, the shutoff valve device 1060 includes, as the shutoff valve 1050, the first shutoff valve 1052 and the second shutoff valve 1054 dedicated for preventing refrigerant leakage. However, in the shutoff valve device 1060, a valve used for a purpose other than the purpose of preventing the refrigerant leakage may be used as the shutoff valve 1050.

Figure 12:
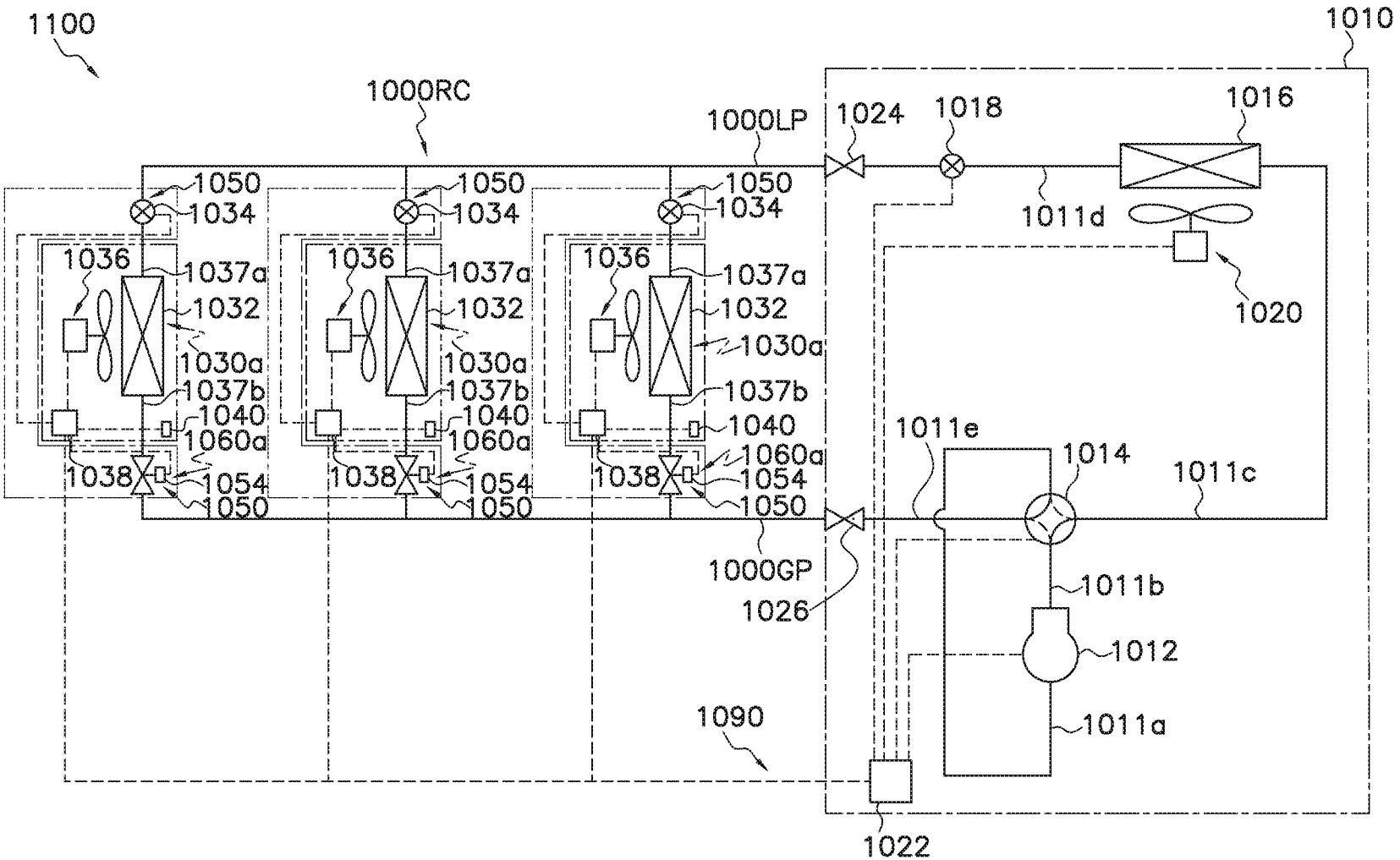
FIG. 12 is a schematic configuration diagram of an air conditioner including a shutoff valve device according to Modification 2B.

For example, the shutoff valve device 1060*a* of the air conditioner 1100 illustrated in FIG. 12 does not include the first shutoff valve 1052. The utilization unit 1030*a* of the air conditioner 1100 illustrated in FIG. 12 does not include the second expansion valve 1034, and instead, the shutoff valve device 1060*a* includes the second expansion valve 1034 as the shutoff valve 1050. In short, the shutoff valve device 1060*a* includes the second expansion valve 1034 and the second shutoff valve 1054 as the shutoff valve 1050.

In the air conditioner 1100 illustrated in FIG. 12, the controller 1090 of the air conditioner 1100 also functions as a control unit of the shutoff valve device 1060*a*. However, the present disclosure is not limited to such a configuration, and the shutoff valve device 1060*a* may include a control unit that controls operations of the second expansion valve 1034 and the second shutoff valve 1054. During the cooling operation and the heating operation, the controller 1090 adjusts the opening degree of the second expansion valve 1034 based on various instructions (set temperature, set air volume, and the like) input to the remote control unit and measurement values of various temperature sensors and pressure sensors. When the refrigerant is detected by the refrigerant detector 1040 of any of the utilization units 1030, the controller 1090 closes the second expansion valve 1034 and the second shutoff valve 1054 of the shutoff valve device 1060 corresponding to the utilization unit 1030 in which the refrigerant is detected.

(5-3) Modification 2C

Figure 13:
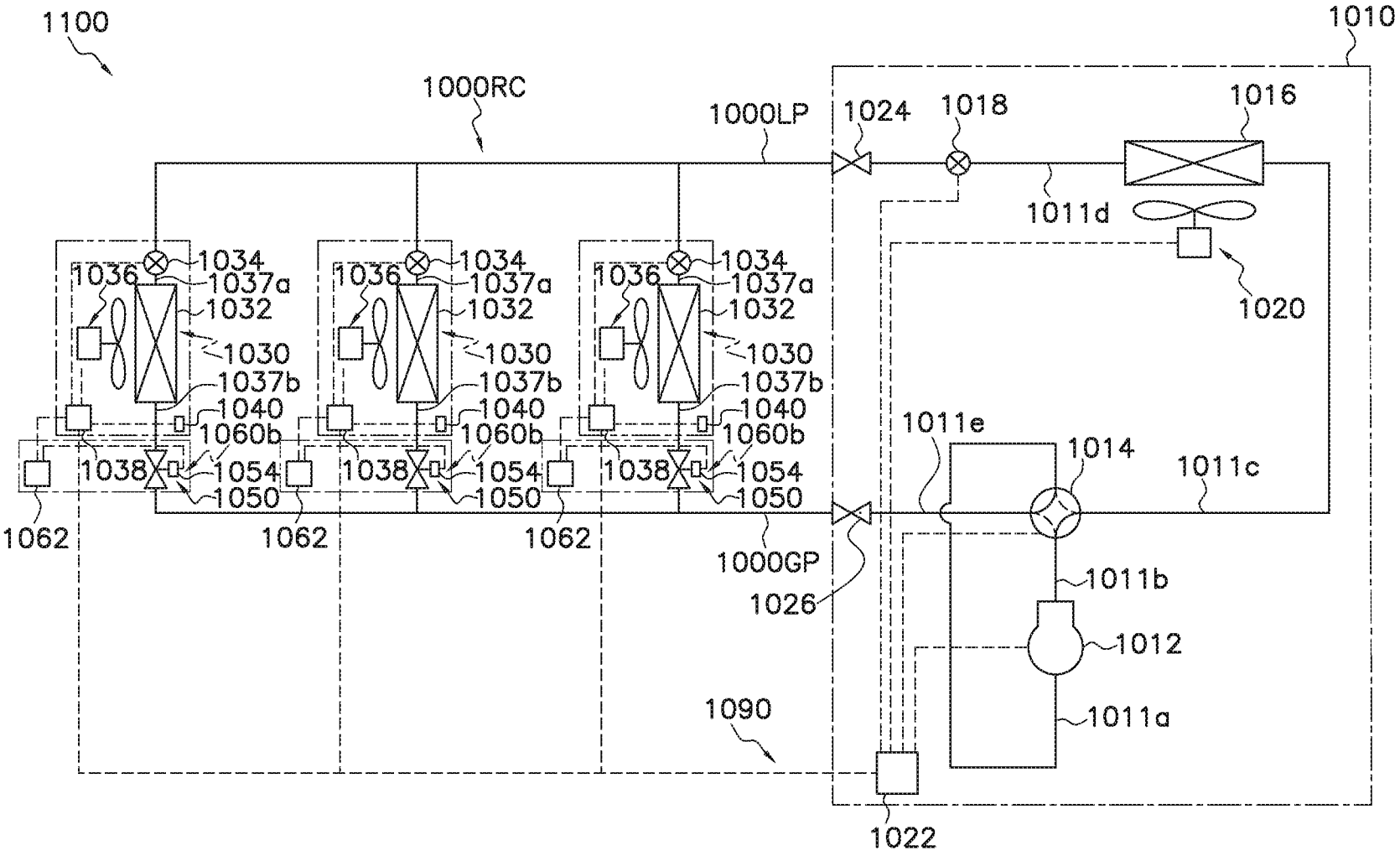
FIG. 13 is a schematic configuration diagram of an air conditioner including a shutoff valve device according to Modification 2C.

In the above-described embodiments, the shutoff valve device 1060 includes, as the shutoff valve 1050, both the first shutoff valve 1052 disposed in the liquid-refrigerant connection pipe 1000LP and the second shutoff valve 1054 disposed in the gas-refrigerant connection pipe 1000GP. However, as illustrated in FIG. 13, the shutoff valve device 1060*b* of the air conditioner 1100 may include only the second shutoff valve 1054 as the shutoff valve 1050.

Here, when the refrigerant is detected by the refrigerant detector 1040 of any of the utilization units 1030, the controller 1090 transmits an instruction signal to the control unit 1062 of the shutoff valve device 1060*b* corresponding to the utilization unit 1030 in which the refrigerant is detected so as to close the second shutoff valve 1054. Further, when the refrigerant detector 1040 of any of the utilization units 1030 detects the refrigerant, the controller 1090 may close the second expansion valve 1034 of the utilization unit 1030 in which the refrigerant is detected.

(5-4) Modification 2D

In the above-described embodiments, the shutoff valve device 1060 includes the main body casing 1064 that accommodates the shutoff valve 1050 therein, but the present disclosure is not limited thereto. The shutoff valve device 1060 may not include the main body casing 1064, and the shutoff valve 1050 may be disposed in the attic space 1000S as it is.

The electric component 1062*a* may also be disposed in the attic space 1000S as it is, instead of in the electric component box 1066.

(5-5) Modification 2E

In the above-described embodiments, one shutoff valve device 1060 is provided for each utilization unit 1030, but the present disclosure is not limited thereto. For example, the shutoff valve device 1060 may be a device in which the shutoff valves 1050 for the plurality of utilization units 1030 are accommodated in one main body casing 1064.

(5-6) Modification 2F

In the above-described embodiments, one first shutoff valve 1052 and one second shutoff valve 1054 are provided for each utilization unit 1030, but the present disclosure is not limited thereto.

For example, in the air conditioner, one first shutoff valve and one second shutoff valve may be provided in each of the liquid refrigerant pipe and the gas refrigerant pipe before being branched to supply the refrigerant to a plurality of utilization units 1030 (referred to as a utilization unit group). When the refrigerant is detected by one refrigerant detector 1040 of the utilization units belonging to the utilization unit group, the inflow of the refrigerant into the plurality of utilization units 1030 belonging to the utilization unit group may be suppressed by closing the first shutoff valve and the second shutoff valve. In other words, the shutoff valve device 1060 may be a device that suppresses inflow of the refrigerant into the plurality of utilization units 1030 by one first shutoff valve 1052 and/or one second shutoff valve 1054.

Third Embodiments

(1) Overall Outline

Figure 14:
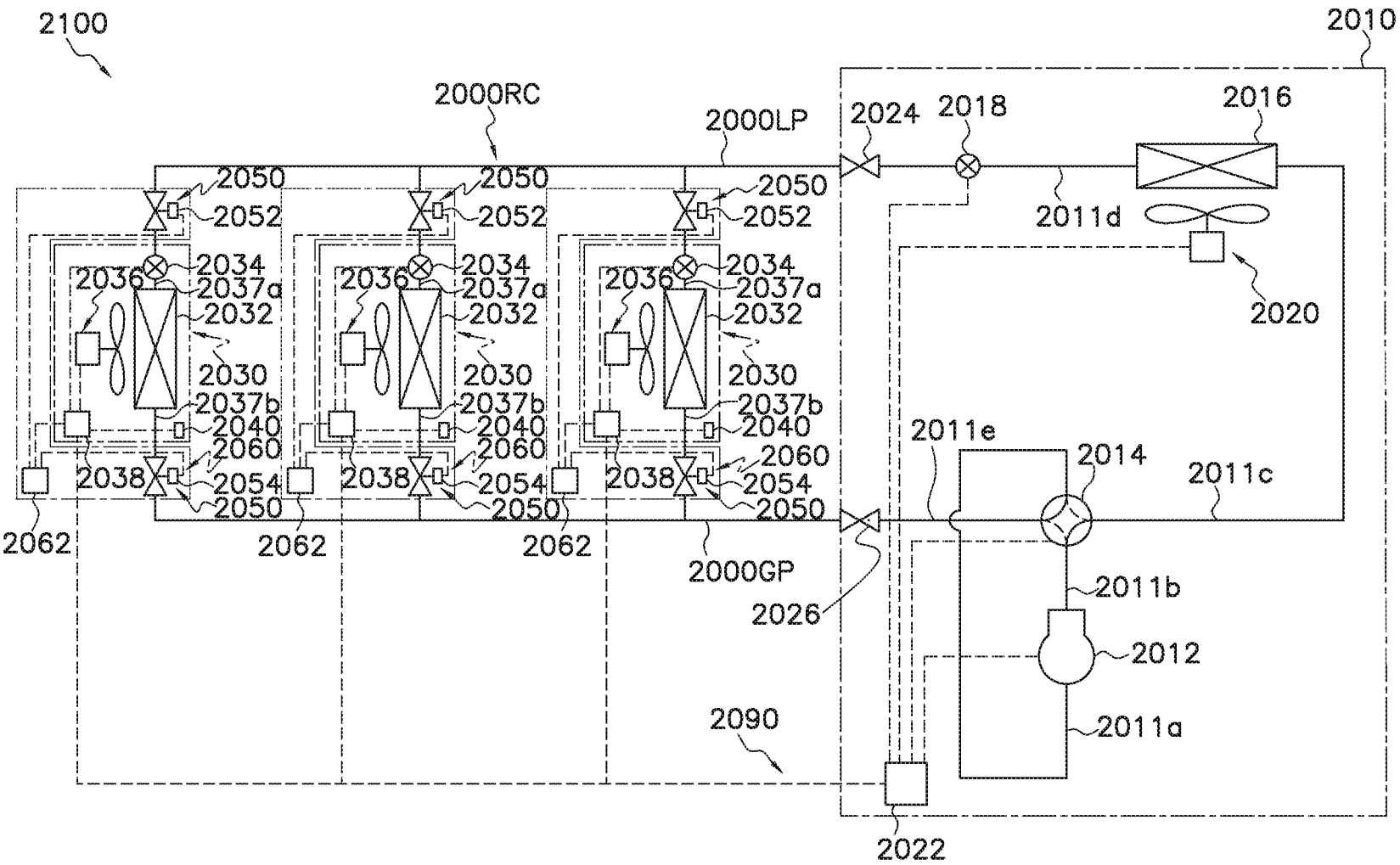
FIG. 14 is a schematic configuration diagram of an air conditioner according to one or more embodiments.
Figure 15:
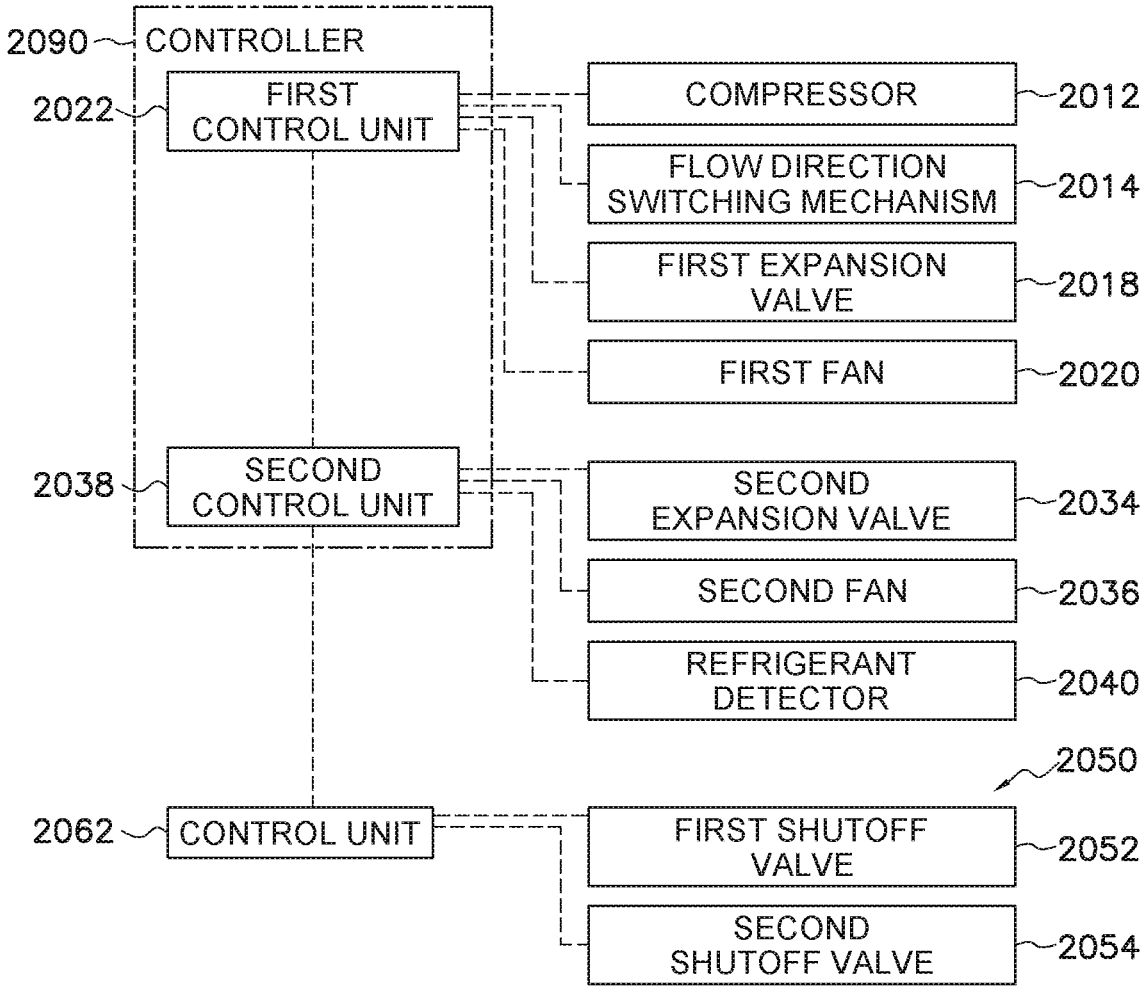
FIG. 15 is a control block diagram of the air conditioner of FIG. 14.

An outline of an air conditioner 2100 according to one or more embodiments will be described with reference to FIGS. 14 and 15. FIG. 14 is a schematic configuration diagram of the air conditioner 2100. FIG. 15 is a control block diagram of the air conditioner 2100. As described later, in one or more embodiments, the air conditioner 2100 includes a plurality of utilization units 2030 each having a second control unit 2038 and a plurality of shutoff valve devices 2060 each having a control unit 2062. However, in FIG. 15, only one second control unit 2038 and one control unit 2062 are illustrated in order to avoid complication of the drawing.

Note that the overall outline of the air conditioner 2100 according to one or more embodiments is similar to the overall outline of the air conditioner 1100 according to the above-described embodiments if reference numerals in the 1000 series are replaced with reference numerals in the 2000 series, and thus the description thereof will be omitted here.

(2) Detailed Configuration

The heat source unit 2010, the utilization unit 2030, and the shutoff valve device 2060 will be described in detail.

(2-1) Heat Source Unit

The description of the heat source unit 2010 according to one or more embodiments is similar to the description of the heat source unit 1010 according to the above-described embodiments if reference numerals in the 1000 series are replaced with reference numerals in the 2000 series, and thus the description thereof will be omitted here.

(2-2) Utilization Unit

The utilization unit 2030 will be described. In the utilization unit 2030, heat is exchanged between the refrigerant and the air in the air conditioning target space 2000R in the utilization heat exchanger 2032 described later, and as a result, cooling or heating of the air conditioning target space 2000R is performed.

In one or more embodiments, the air conditioner 2100 includes three utilization units 2030. Structures and capabilities of the three utilization units 2030 may be the same or different from each other. Here, each of the utilization units 2030 will be described as having the same configuration.

Figure 16:
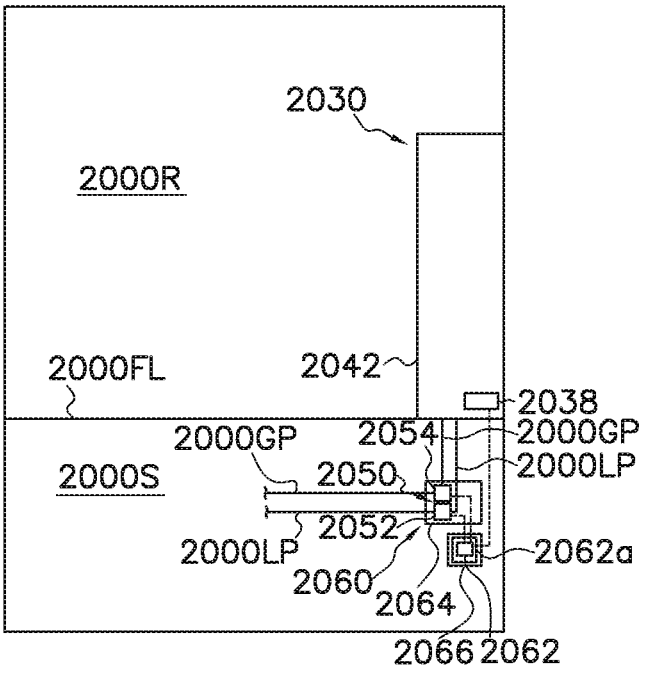
FIG. 16 is a diagram schematically illustrating installation states of a utilization unit and a shutoff valve device of the air conditioner in FIG. 14.

The type of the utilization unit 2030 is a floor type as illustrated in FIG. 16, and is installed on the floor of the air conditioning target space 2000R. The air conditioner 2100 may include another type of utilization unit 2030 in addition to the floor utilization unit 2030.

As shown in FIGS. 14 to 16, the utilization unit 2030 mainly includes a casing 2042, a utilization heat exchanger 2032, a second expansion valve 2034, a second fan 2036, a refrigerant detector 2040, and a second control unit 2038. Note that the configuration of the utilization unit 2030 illustrated here is merely an example. The utilization unit 2030 may not have a part of the illustrated configuration or may have a configuration other than the illustrated configuration as long as the air conditioner 2100 can function.

The utilization unit 2030 includes, as refrigerant pipes, a liquid refrigerant pipe 2037*a* and a gas refrigerant pipe 2037*b* connected to the utilization heat exchanger 2032 (see FIG. 14). The liquid refrigerant pipe 2037*a* connects the liquid-refrigerant connection pipe 2000LP and the liquid side of the utilization heat exchanger 2032. The gas refrigerant pipe 2037*b* connects the gas-refrigerant connection pipe 2000GP and the gas side of the utilization heat exchanger 2032. The liquid refrigerant pipe 2037*a* is provided with a second expansion valve 2034.

(2-2-1) Casing

The casing 2042 accommodates therein various devices of the utilization unit 2030 including the utilization heat exchanger 2032, the second expansion valve 2034, and the second fan 2036. As shown in FIG. 16, the casing 2042 is disposed in the air conditioning target space 2000R.

The casing 2042 is provided with a suction port (not shown) for taking in the air in the air conditioning target space 2000R. The casing 2042 has a blow-out port (not shown) through which air introduced into the casing 2042 through the suction port and having exchanged heat with the refrigerant in the utilization heat exchanger 2032 is blown out into the air conditioning target space 2000R.

(2-2-2) Indoor Heat Exchanger

In the utilization heat exchanger 2032, heat is exchanged between the refrigerant flowing through the utilization heat exchanger 2032 and air. The utilization heat exchanger 2032 functions as an evaporator of the refrigerant during the cooling operation, and functions as a condenser (radiator) of the refrigerant during the heating operation. Although not limited, the utilization heat exchanger 2032 is, for example, a fin-and-tube heat exchanger having a plurality of heat transfer tubes and a plurality of heat transfer fins.

(2-2-3) Second Expansion Valve

The second expansion valve 2034 is a mechanism that decompresses the refrigerant and adjusts the flow rate of the refrigerant. In one or more embodiments, the second expansion valve 2034 is an electronic expansion valve whose opening degree is adjustable. The opening degree of the second expansion valve 2034 is appropriately adjusted according to the operation situation. The second expansion valve 2034 is not limited to the electronic expansion valve, and may be another type of valve such as an automatic temperature expansion valve.

(2-2-4) Second Fan

The second fan 2036 is a blower that generates an air flow that flows into the casing 2042 from a suction port (not shown) of the casing 2042, passes through the utilization heat exchanger 2032, and then flows out of the casing 2042 from a blow-out port of the casing 2042. The second fan 2036 is, for example, an inverter control-type fan. However, the second fan 2036 may be a constant-speed fan.

(2-2-5) Refrigerant Detector

The refrigerant detector 2040 is a sensor that detects the leakage of refrigerant at the utilization unit 2030. The refrigerant detector 2040 is provided, for example, in the casing 2042 of the utilization unit 2030. The refrigerant detector 2040 may be disposed outside the casing 2042 of the utilization unit 2030. A plurality of refrigerant detectors 2040 may be provided.

The refrigerant detector 2040 is, for example, a semiconductor-type sensor. The semiconductor refrigerant detector 2040 includes a semiconductor-type detection element (not shown). The semiconductor detector element has electric conductivity that changes depending on whether it is in a case where no refrigerant gas exists therearound and in a case where refrigerant gas exists therearound. When the refrigerant gas exists around the semiconductor-type detection element, the refrigerant detector 2040 outputs a relatively large current as a detection signal. On the other hand, when the refrigerant gas does not exist around the semiconductor-type detection element, the refrigerant detector 2040 outputs a relatively small current as a detection signal.

The type of the refrigerant detector 2040 is not limited to the semiconductor type, and may be any sensor capable of detecting refrigerant gas. For example, the refrigerant detector 2040 may be an infrared sensor that outputs a detection signal according to a detection result of the refrigerant.

(2-2-6) Second Control Unit

The second control unit 2038 controls operations of various devices of the utilization unit 2030. The second control unit 2038 includes a microcontroller unit (MCU), various electric circuits, and electronic circuits (not shown). The MCU includes a CPU, a memory, an I/O interface, and the like. The memory of the MCU stores various programs to be executed by the CPU of the MCU. Note that the various functions of the second control unit 2038 does not need to be implemented by software, and may be implemented by hardware or may be implemented by cooperation of hardware and software.

The second control unit 2038 is electrically connected to various devices of the utilization unit 2030 including the second expansion valve 2034 and the second fan 2036 (see FIG. 15). The second control unit 2038 is electrically connected to the refrigerant detector 2040. Further, the second control unit 2038 is electrically connected to a sensor (not shown) provided in the utilization unit 2030. Although not limited, the sensors (not shown) include a temperature sensor provided in the utilization heat exchanger 2032 and the liquid refrigerant pipe 2037*a*, a temperature sensor that measures the temperature of the air conditioning target space 2000R, and the like. The utilization unit 2030 may include all or some of these sensors.

The second control unit 2038 is communicably connected to the control unit 2062 that controls the operations of the first shutoff valve 2052 and the second shutoff valve 2054 of the shutoff valve device 2060 by a communication line (see FIG. 15).

As illustrated in FIG. 15, the second control unit 2038 is connected to the first control unit 2022 of the heat source unit 2010 via a communication line. The second control unit 2038 is communicably connected to a remote control unit for operating the air conditioner 2100 (not shown) via a communication line. The first control unit 2022 and the second control unit 2038 cooperate to function as a controller 2090 that controls the operation of the air conditioner 2100.

The function of the controller 2090 will be described. Some or all of various functions of the controller 2090 described below may be executed by a control device provided separately from the first control unit 2022 and the second control unit 2038.

The controller 2090 controls the operation of the flow direction switching mechanism 2014 such that the heat-source heat exchanger 2016 functions as a condenser of the refrigerant and the utilization heat exchanger 2032 functions as an evaporator of the refrigerant during the cooling operation. During the heating operation, the controller 2090 controls the operation of the flow direction switching mechanism 2014 such that the heat-source heat exchanger 2016 functions as an evaporator of the refrigerant and the utilization heat exchanger 2032 functions as a condenser of the refrigerant. The controller 2090 operates the compressor 2012, the first fan 2020, and the second fan 2036 during the cooling operation and the heating operation. During the cooling operation and the heating operation, the controller 2090 adjusts the numbers of rotations of the motors of the compressor 2012, the first fan 2020, and the second fan 2036 and the opening degrees of the first expansion valve 2018 and the second expansion valve 2034 based on various instructions (set temperature, set air volume, and the like) input to the remote control unit and measurement values of various temperature sensors and pressure sensors. Various control modes are generally known for the control of the operations of the various devices of the air conditioner 2100 during the cooling operation and the heating operation, and thus, the description thereof will be omitted here.

The control of the air conditioner 2100 by the controller 2090 when the refrigerant is detected by the refrigerant detector 2040 of any of the utilization units 2030 will be described later.

(2-3) Shutoff Valve Device

Each shutoff valve device 2060 is installed corresponding to one of the utilization units 2030. The shutoff valve device 2060 is a device that closes the shutoff valve 2050 included in the shutoff valve device 2060 to suppress the inflow of the refrigerant into the utilization unit 2030 corresponding to the shutoff valve device 2060.

The shutoff valve device 2060 mainly includes a shutoff valve 2050, a main body casing 2064, an electric component 2062*a*, and an electric component box 2066 that accommodates the electric component 2062*a*. The electric component 2062*a* includes a control unit 2062 that controls operations of the first shutoff valve 2052 and the second shutoff valve 2054.

(2-3-1) Shutoff Valve

The shutoff valve 2050 includes at least one of a first shutoff valve disposed in the liquid-refrigerant connection pipe 2000LP and a second shutoff valve disposed in the gas-refrigerant connection pipe 2000GP. In one or more embodiments, the shutoff valve 2050 of each shutoff valve device 2060 includes both the first shutoff valve 2052 disposed in the liquid-refrigerant connection pipe 2000LP and the second shutoff valve 2054 disposed in the gas-refrigerant connection pipe 2000GP.

A liquid-refrigerant connection pipe 2000LP connecting the heat source unit 2010 and the first shutoff valve 2052 is connected to one end of the first shutoff valve 2052 of the shutoff valve device 2060. A liquid-refrigerant connection pipe 2000LP that connects the liquid refrigerant pipe 2037*a* of the utilization unit 2030 corresponding to the shutoff valve device 2060 and the first shutoff valve 2052 is connected to the other end of the first shutoff valve 2052 of the shutoff valve device 2060.

A gas-refrigerant connection pipe 2000GP connecting the heat source unit 2010 and the second shutoff valve 2054 is connected to one end of the second shutoff valve 2054 of the shutoff valve device 2060. A gas-refrigerant connection pipe 2000GP that connects the gas refrigerant pipe 2037*b* of the utilization unit 2030 corresponding to the shutoff valve device 2060 and the second shutoff valve 2054 is connected to the other end of the second shutoff valve 2054 of the shutoff valve device 2060.

The first shutoff valve 2052 and the second shutoff valve 2054 are valves that suppress the leakage of refrigerant into the air conditioning target space 2000R when the leakage of refrigerant occurs at the utilization unit 2030. The first shutoff valve 2052 and the second shutoff valve 2054 are, for example, electromagnetic valves capable of switching between a closed state (fully closed) and an open state (fully open). However, the types of the first shutoff valve 2052 and the second shutoff valve 2054 are not limited to the electromagnetic valve, and may be, for example, an electric valve.

The first shutoff valve 2052 and the second shutoff valve 2054 of the shutoff valve device 2060 are normally opened. The normal time here means a time when the second control unit 2038 of the utilization unit 2030 corresponding to the shutoff valve device 2060 has not transmitted a signal instructing the control unit 2062 to close the shutoff valve 2050.

On the other hand, when the refrigerant detector 2040 of the utilization unit 2030 corresponding to the shutoff valve device 2060 detects the refrigerant, the first shutoff valve 2052 and the second shutoff valve 2054 are closed. Specifically, when the refrigerant detector 2040 of the utilization unit 2030 corresponding to the shutoff valve device 2060 detects the refrigerant and the second control unit 2038 of the corresponding utilization unit 2030 transmits a signal instructing to close the shutoff valve 2050 to the control unit 2062 of the corresponding shutoff valve device 2060, the control unit 2062 that has received the signal performs control to close the first shutoff valve 2052 and the second shutoff valve 2054. When the first shutoff valve 2052 and the second shutoff valve 2054 of the shutoff valve device 2060 are closed, the inflow of the refrigerant from the heat source unit 2010, the pipe connecting the heat source unit 2010 and the first shutoff valve 2052, and the pipe connecting the heat source unit 2010 and the second shutoff valve 2054 to the utilization unit 2030 corresponding to the shutoff valve device 2060 is suppressed.

As illustrated in FIG. 16, the shutoff valve 2050 (the first shutoff valve 2052 and the second shutoff valve 2054) is disposed in the underfloor space 2000S below the floor 2000FL of the air conditioning target space 2000R. The shutoff valve 2050 may be arranged in the underfloor space 2000S and in the vicinity of the corresponding utilization unit 2030. The shutoff valve 2050 is disposed, for example, in the underfloor space 2000S and in the vicinity immediately below the corresponding utilization unit 2030. However, the arrangement of the shutoff valve 2050 is not limited to the vicinity immediately below the corresponding utilization unit 2030.

When the lower floor exists below the air conditioning target space 2000R in the building in which the air conditioner 2100 is installed, the underfloor space 2000S is a space between the floor 2000FL of the air conditioning target space 2000R and the ceiling of the lower floor (one floor below) of the air conditioning target space 2000R. For example, the underfloor space 2000S is a space existing between a building material constituting the floor 2000FL and a concrete framework partitioning a floor where the air conditioning target space 2000R exists and a floor immediately below that floor. Further, for example, the underfloor space 2000S may be a space between a concrete framework that partitions a floor where the air conditioning target space 2000R exists and a floor immediately below that floor, and a ceiling of a floor immediately below the floor where the air conditioning target space 2000R exists (an attic space of a floor immediately below). When the air conditioning target space 2000R is the lowest floor in the building in which the air conditioner 2100 is installed (when there is no lower floor below the air conditioning target space 2000R), the underfloor space 2000S is a space between the floor 2000FL of the air conditioning target space 2000R and the foundation of the building.

The underfloor space 2000S is a space partitioned from the air conditioning target space 2000R by the building material constituting the floor 2000FL. The fact that the underfloor space 2000S and the air conditioning target space 2000R are partitioned does not necessarily mean that both spaces are partitioned in an airtight state, but means that the flow of air between both spaces is at least suppressed by the building material constituting the floor 2000FL. For example, some air may flow between the underfloor space 2000S and the air conditioning target space 2000R via a gap between building materials.

In the air conditioner 2100 of one or more embodiments, since the shutoff valve 2050 is installed in the underfloor space 2000S, even if the refrigerant leaks around the shutoff valve 2050, the refrigerant flows not into the air conditioning target space 2000R but into the underfloor space 2000S partitioned from the air conditioning target space 2000R. Since the refrigerant used in the air conditioner 2100 is generally denser than air, the refrigerant is relatively less likely to flow from the underfloor space 2000S into the air conditioning target space 2000R above the underfloor space 2000S. In short, in the air conditioner 2100 according to one or more embodiments, the refrigerant is less likely to flow into the air conditioning target space 2000R where people are active. Therefore, the air conditioner 2100 has high safety even when, for example, a flammable refrigerant is used.

(2-3-2) Main Body Casing

The main body casing 2064 is a casing that accommodates the shutoff valve 2050. Specifically, the main body casing 2064 is a casing that accommodates the first shutoff valve 2052 and the second shutoff valve 2054.

Figure 17A:
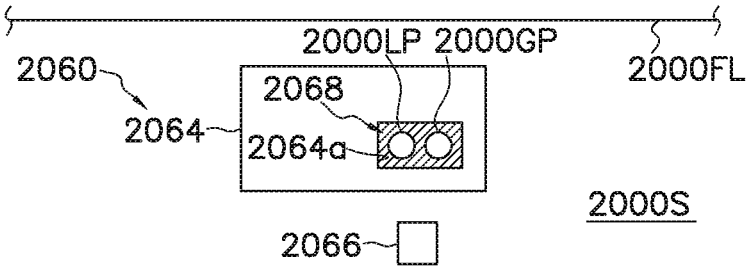
FIG. 17A is a side view schematically illustrating a main body casing and an electric component box of the shutoff valve device.

As shown in FIG. 17A, the main body casing 2064 is installed in the underfloor space 2000S. In order to dispose the shutoff valve 2050 in the vicinity of the corresponding utilization unit 2030, the main body casing 2064 may be installed in the vicinity of the corresponding utilization unit 2030. Although not limited, the main body casing 2064 is installed in the underfloor space 2000S and in the vicinity immediately below the corresponding utilization unit 2030.

For example, as illustrated in FIG. 17A, the main body casing 2064 is formed with an opening 2064*a* through which a liquid-refrigerant connection pipe 2000LP connected to both ends of the first shutoff valve 2052 and a gas-refrigerant connection pipe 2000GP connected to both ends of the second shutoff valve 2054 are inserted. In FIG. 17A, a part of these openings 2064*a* (for example, the opening 2064*a* through which the liquid-refrigerant connection pipe 2000LP connecting the heat source unit 2010 and the first shutoff valve 2052 and the gas-refrigerant connection pipe 2000GP connecting the heat source unit 2010 and the second shutoff valve 2054 pass) is illustrated. In the example of FIG. 17A, a plurality of refrigerant pipes (one liquid-refrigerant connection pipe 2000LP and one gas-refrigerant connection pipe 2000GP) are arranged to extend through one opening 2064*a*.

Figure 17B:
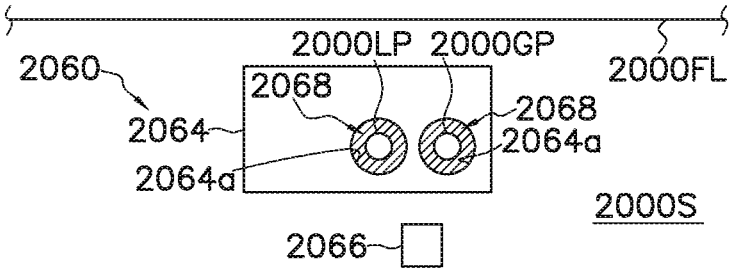
FIG. 17B is a side view schematically illustrating a main body casing and an electric component box of another example of the shutoff valve device.

In place of the openings through which the plurality of refrigerant pipes pass, the main body casing 2064 may include, as shown in FIG. 17B, openings 2064*a* arranged so that one refrigerant pipe (one liquid-refrigerant connection pipe 2000LP or one gas-refrigerant connection pipe 2000GP) extends through each of the opening 2064*a*.

The opening 2064*a* may be provided with a heat insulating material 2068 that closes a gap between the opening 2064*a* and the liquid-refrigerant connection pipe 2000LP, a gap between the opening 2064*a* and the gas-refrigerant connection pipe 2000GP, and a gap between the liquid-refrigerant connection pipe 2000LP and the gas-refrigerant connection pipe 2000GP. By closing the gap between the opening 2064*a* and the connection pipes 2000LP and 2000GP and the gap between the refrigerant pipes with the heat insulating material 2068 in this manner, the leakage of refrigerant into the underfloor space 2000S is suppressed even if the refrigerant leaks inside the main body casing 2064, and safety is therefore high.

(2-3-3) Electric Component

The electric component 2062*a* includes various components for operating the first shutoff valve 2052 and the second shutoff valve 2054. Although not limited, the electric component 2062*a* includes, for example, a switching unit capable of switching the flow of current, such as a printed circuit board, an electromagnetic relay, and a switching element, a terminal block to which power is supplied, and an input unit to which a signal from the second control unit 2038 is input. The electric component 2062*a* is electrically connected to the first shutoff valve 2052 and the second shutoff valve 2054 by an electric wire for supplying a drive voltage. At least a part of the electric component 2062*a* functions as the control unit 2062 that closes the first shutoff valve 2052 and the second shutoff valve 2054 in response to a signal requesting closing of the shutoff valve 2050 from the second control unit 2038 of the utilization unit 2030.

The control unit 2062 includes, for example, a microcontroller unit (MCU), various electric circuits, and electronic circuits (not shown). The MCU includes a CPU, a memory, an I/O interface, and the like. The memory of the MCU stores various programs to be executed by the CPU of the MCU. Note that the various functions of the control unit 2062 does not need to be implemented by software, and may be implemented by hardware or may be implemented by cooperation of hardware and software.

The electric component 2062*a* is accommodated in the electric component box 2066. The electric component box 2066 may be disposed outside the main body casing 2064. The electric component box 2066 is installed, for example, in the underfloor space 2000S. When the electric component box 2066 and the main body casing 2064 have independent configurations, the electric component box 2066 may not be disposed in the vicinity of the main body casing 2064. The installation position of the electric component box 2066 may be appropriately determined.

(3) Control of Air Conditioner by Controller at Time of Refrigerant Detection

The control of the air conditioner 2100 by the controller 2090 when the refrigerant is detected by the refrigerant detector 2040 of any of the utilization units 2030 will be described. Here, the case where the refrigerant is detected by the refrigerant detector 2040 means a case where the value of the current output as the detection signal by the refrigerant detector 2040 is larger than a predetermined threshold.

When the refrigerant is detected by the refrigerant detector 2040 of any of the utilization units 2030, the controller 2090 transmits a signal instructing to close the shutoff valve 2050 of the shutoff valve device 2060 to the control unit 2062 of the shutoff valve device 2060 corresponding to the utilization unit 2030 in which the refrigerant is detected. The signal instructing to close the shutoff valve 2050 may be a contact signal. The control unit 2062 of the shutoff valve device 2060 closes the shutoff valve 2050 (in one or more embodiments, the first shutoff valve 2052 and the second shutoff valve 2054) based on this signal.

When the refrigerant is detected by the refrigerant detector 2040 of any of the utilization units 2030, the controller 2090 may notify of the leakage of refrigerant using an alarm (not shown) in addition to transmitting a signal instructing to close the shutoff valve 2050 to the control unit 2062 of the shutoff valve device 2060.

When the refrigerant is detected by the refrigerant detector 2040 of any of the utilization units 2030, the controller 2090 may stop the operation of the entire air conditioner 2100 by stopping the operation of the compressor 2012 in addition to transmitting a signal instructing to close the shutoff valve 2050 to the control unit 2062 of the shutoff valve device 2060.

When the refrigerant is detected by the refrigerant detector 2040 of any of the utilization units 2030, the controller 2090 may transmit a signal instructing to close the shutoff valve 2050 to the control unit 2062 of the shutoff valve device 2060 corresponding to that utilization unit 2030 and may further transmit a signal instructing to close the shutoff valve 2050 to the control unit 2062 of another shutoff valve device 2060 (for example, all the shutoff valve devices 2060).

(4) Features (4-1)

The air conditioner 2100 of one or more embodiments includes a utilization unit 2030 as an air conditioning indoor unit, a heat source unit 2010 as an air conditioning heat source unit, and a shutoff valve device 2060. The utilization unit 2030 is installed in the air conditioning target space 2000R. The utilization unit 2030 is a floor type. The heat source unit 2010 is connected to the utilization unit 2030 via a liquid-refrigerant connection pipe 2000LP and a gas-refrigerant connection pipe 2000GP. The shutoff valve device 2060 includes a shutoff valve 2050 disposed in the underfloor space 2000S below the floor 2000FL of the air conditioning target space 2000R. The shutoff valve 2050 includes at least one of a first shutoff valve 2052 disposed in the liquid-refrigerant connection pipe 2000LP and a second shutoff valve 2054 disposed in the gas-refrigerant connection pipe 2000GP. In one or more embodiments, the shutoff valve 2050 includes both the first shutoff valve 2052 and the second shutoff valve 2054.

Conventionally, as disclosed in Patent Literature 2 (JP 2013-19621 A), there is known an air conditioner in which an air conditioning indoor unit is provided with a shutoff valve for preventing the leakage of refrigerant separately from the air conditioning indoor unit. The shutoff valve is disposed in the vicinity of the air conditioning indoor unit to reduce the amount of refrigerant leaking from the air conditioning indoor unit when the leakage of refrigerant is detected.

However, when the shutoff valve is disposed in the air conditioning target space adjacent to the air conditioning indoor unit disposed in the air conditioning target space, if the refrigerant leaks from the shutoff valve, a relatively large amount of refrigerant may leak into the air conditioning target space.

In the air conditioner 2100, even if the refrigerant leaks around the shutoff valve 2050, the refrigerant flows not into the air conditioning target space 2000R but into the underfloor space 2000S partitioned from the air conditioning target space 2000R, and thus safety is high.

Since the refrigerant used in the air conditioner 2100 is generally denser than air, the refrigerant flowing into the underfloor space 2000S is relatively less likely to flow into the air conditioning target space 2000R.

Further, in the air conditioner 2100, since the underfloor space 2000S close to the utilization unit 2030 is used as the installation place of the shutoff valve 2050 for the floor type utilization unit 2030, the length of the pipe connecting the utilization unit 2030 and the shutoff valve 2050 tends to be relatively short. Therefore, even if the refrigerant leaks from the utilization unit 2030, the amount of refrigerant leaking from the utilization unit 2030 is easily reduced.

(4-2)

In the air conditioner 2100 of one or more embodiments, the shutoff valve device 2060 includes a main body casing 2064 as an example of a casing that accommodates the first shutoff valve 2052 and the second shutoff valve 2054.

In the present air conditioner 2100, the shutoff valve device 2060 is a unit in which the first shutoff valve 2052, the second shutoff valve 2054, and the main body casing 2064 accommodating them are unitized. It is therefore easy to incorporate the shutoff valve device 2060 into the air conditioner 2100.

(4-3)

In the air conditioner 2100 of one or more embodiments, the shutoff valve device 2060 includes an electric component box 2066 that accommodates electric components 2062*a* for operating the shutoff valve 2050. The electric component box 2066 is disposed outside the main body casing 2064.

In the present air conditioner 2100, since the electric component box 2066 is disposed outside the main body casing 2064, if the refrigerant is flammable, and the refrigerant leaks around the shutoff valve 2050, it is possible to suppress contact between the refrigerant and the electric component 2062*a* that can be an ignition source.

(4-4)

In the air conditioner 2100 of one or more embodiments, an opening 2064*a* is formed in the main body casing 2064. The liquid-refrigerant connection pipe 2000LP connected to the first shutoff valve 2052 and the gas-refrigerant connection pipe 2000GP connected to the second shutoff valve 2054 extend through the opening 2064*a* of the main body casing 2064. The shutoff valve device 2060 includes a heat insulating material 2068 that closes a gap between the opening 2064*a* and the liquid-refrigerant connection pipe 2000LP and a gap between the opening 2064*a* and the gas-refrigerant connection pipe 2000GP.

In the present air conditioner 2100, since the gap between the opening 2064*a* and the refrigerant connection pipes 2000LP and 2000GP extending through the opening 2064*a* is closed by the heat insulating material 2068, the leakage of refrigerant into the underfloor space 2000S is suppressed even if the refrigerant leaks inside the main body casing 2064, and safety is high.

(5) Modifications

The above described embodiments may be appropriately modified as described in the following modifications. Some or all of the modifications may be combined with the above-described embodiments or another modification as long as no contradiction occurs.

(5-1) Modification 3A

In the above-described embodiments, the control unit 2062 of the shutoff valve device 2060 controls the operation of the shutoff valve 2050, but the present disclosure is not limited to such a configuration. For example, the shutoff valve device 2060 may not include the control unit 2062, and the controller 2090 of the air conditioner 2100, more specifically, the second control unit 2038 of the utilization unit 2030, for example, may control the operation of the shutoff valve 2050.

(5-2) Modification 3B

In the above-described embodiments, the shutoff valve device 2060 includes, as the shutoff valve 2050, the first shutoff valve 2052 and the second shutoff valve 2054 dedicated for preventing refrigerant leakage. However, in the shutoff valve device 2060, a valve used for a purpose other than the purpose of preventing refrigerant leakage may be used as the shutoff valve 2050.

Figure 18:
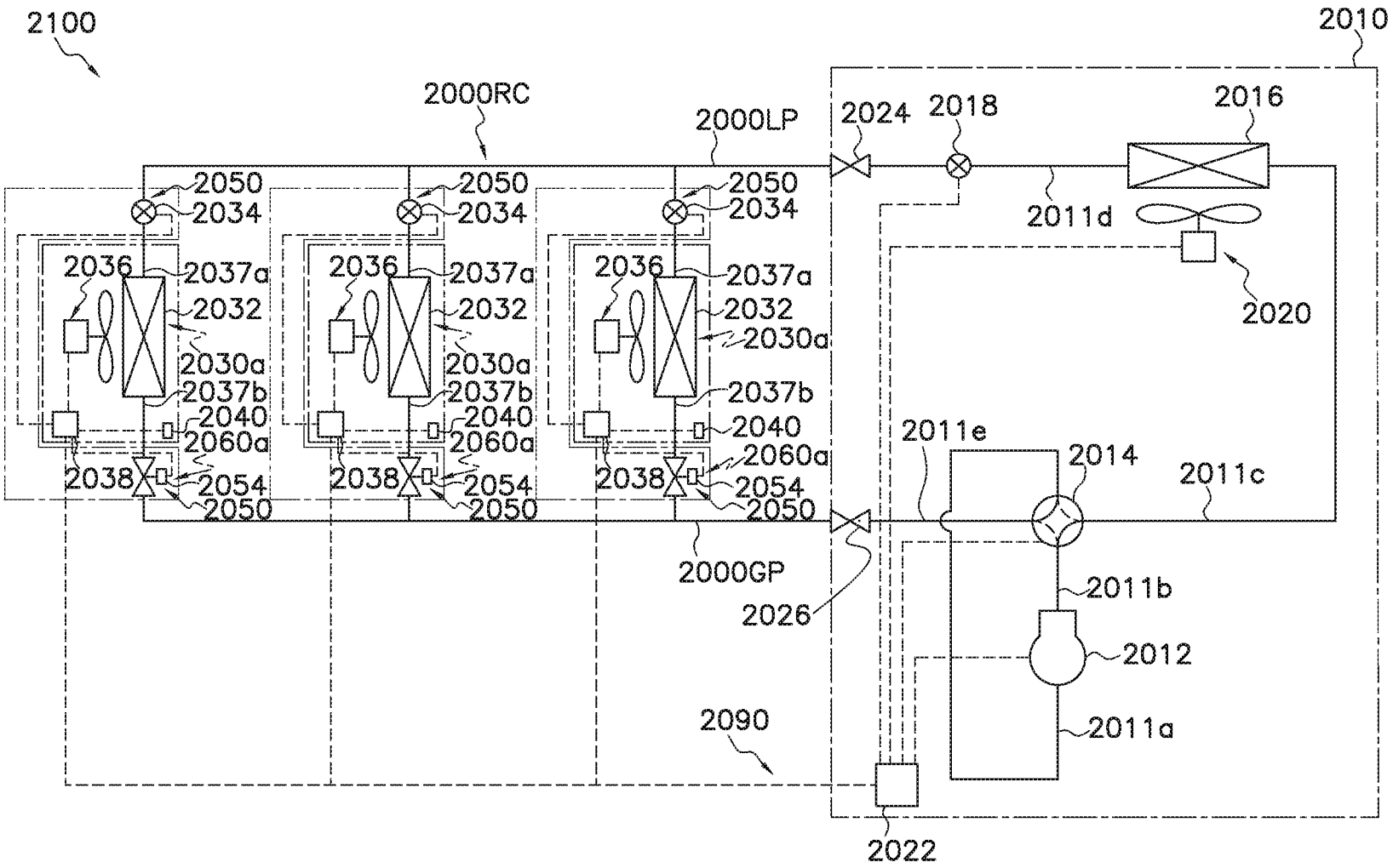
FIG. 18 is a schematic configuration diagram of an air conditioner including a shutoff valve device according to Modification 3B.

For example, the shutoff valve device 2060*a* of the air conditioner 2100 illustrated in FIG. 18 does not include the first shutoff valve 2052. The utilization unit 2030*a* of the air conditioner 2100 illustrated in FIG. 18 does not include the second expansion valve 2034, and instead, the shutoff valve device 2060*a* includes the second expansion valve 2034 as the shutoff valve 2050. In short, the shutoff valve device 2060*a* includes the second expansion valve 2034 and the second shutoff valve 2054 as the shutoff valve 2050.

In the air conditioner 2100 illustrated in FIG. 18, the controller 2090 of the air conditioner 2100 also functions as a control unit of the shutoff valve device 2060*a*. However, the present disclosure is not limited to such a configuration, and the shutoff valve device 2060*a* may include a control unit that controls operations of the second expansion valve 2034 and the second shutoff valve 2054. During the cooling operation and the heating operation, the controller 2090 adjusts the opening degree of the second expansion valve 2034 based on various instructions (set temperature, set air volume, and the like) input to the remote control unit and measurement values of various temperature sensors and pressure sensors. When the refrigerant is detected by the refrigerant detector 2040 of any of the utilization units 2030, the controller 2090 closes the second expansion valve 2034 and the second shutoff valve 2054 of the shutoff valve device 2060 corresponding to the utilization unit 2030 in which the refrigerant is detected.

(5-3) Modification 3C

Figure 19:
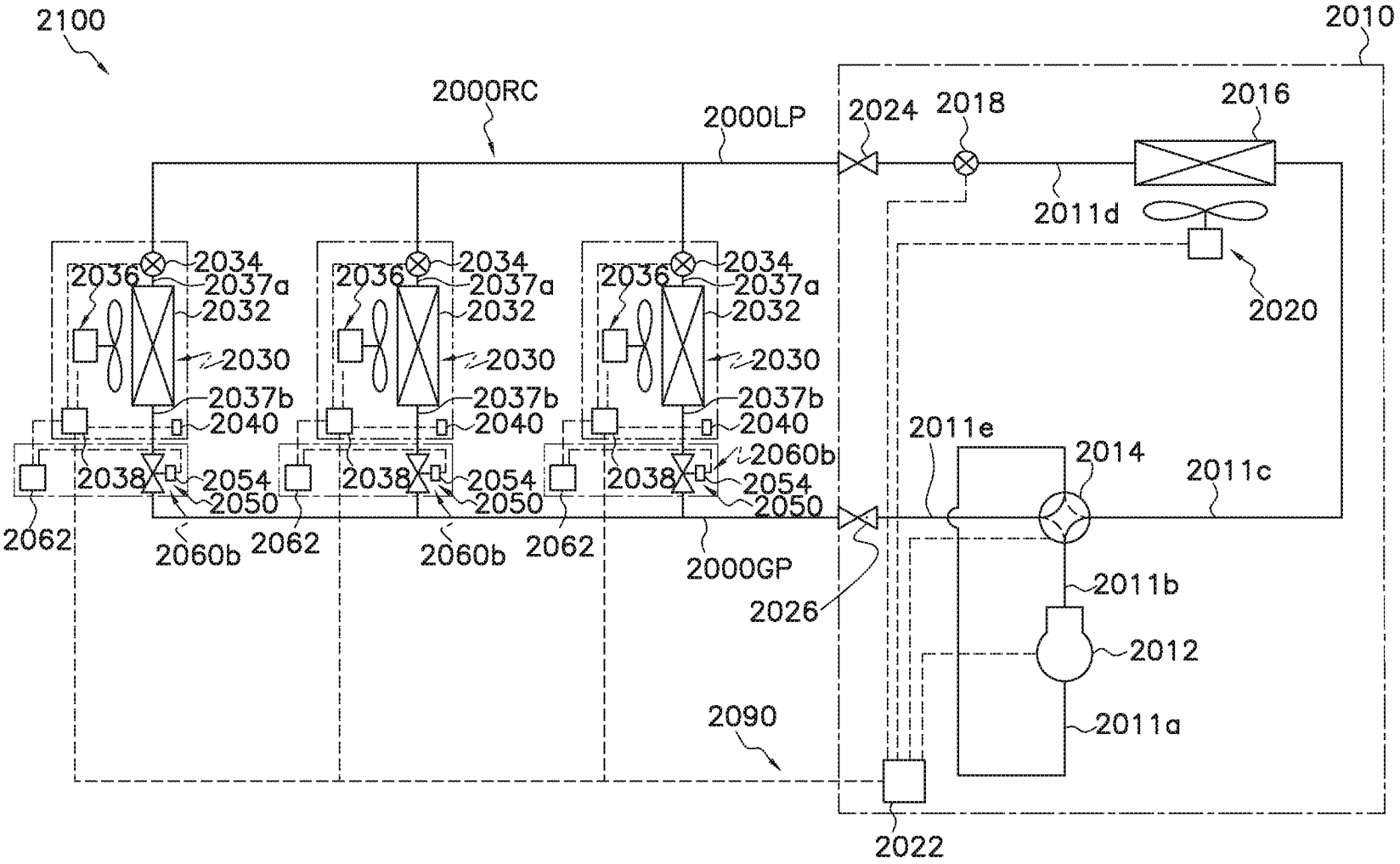
FIG. 19 is a schematic configuration diagram of an air conditioner including a shutoff valve device according to Modification 3C.

In the above-described embodiments, the shutoff valve device 2060 includes, as the shutoff valve 2050, both the first shutoff valve 2052 disposed in the liquid-refrigerant connection pipe 2000LP and the second shutoff valve 2054 disposed in the gas-refrigerant connection pipe 2000GP. However, as illustrated in FIG. 19, the shutoff valve device 2060*b* of the air conditioner 2100 may include only the second shutoff valve 2054 as the shutoff valve 2050.

Here, when the refrigerant is detected by the refrigerant detector 2040 of any of the utilization units 2030, the controller 2090 transmits an instruction signal to the control unit 2062 of the shutoff valve device 2060*b* corresponding to the utilization unit 2030 in which the refrigerant is detected so as to close the second shutoff valve 2054. Further, when the refrigerant detector 2040 of any of the utilization units 2030 detects the refrigerant, the controller 2090 may close the second expansion valve 2034 of the utilization unit 2030 in which the refrigerant is detected.

(5-4) Modification 3D

In the above-described embodiments, the shutoff valve device 2060 includes the main body casing 2064 that accommodates the shutoff valve 2050 therein, but the present disclosure is not limited thereto. The shutoff valve device 2060 may not include the main body casing 2064, and the shutoff valve 2050 may be disposed in the underfloor space 2000S as it is.

In addition, the electric component 2062*a* may also be disposed in the underfloor space 2000S as it is instead of in the electric component box 2066.

(5-5) Modification 3E

In the above-described embodiments, one shutoff valve device 2060 is provided for each utilization unit 2030, but the present disclosure is not limited thereto. For example, the shutoff valve device 2060 may be a device in which the shutoff valves 2050 for the plurality of utilization units 2030 are accommodated in one main body casing 2064.

(5-6) Modification 3F

In the above-described embodiments, one first shutoff valve 2052 and one second shutoff valve 2054 are provided for each utilization unit 2030, but the present disclosure is not limited thereto.

For example, in the air conditioner, one first shutoff valve and one second shutoff valve may be provided in each of the liquid refrigerant pipe and the gas refrigerant pipe before being branched to supply the refrigerant to the plurality of utilization units 2030 (referred to as a utilization unit group). When the refrigerant is detected by one refrigerant detector 2040 of the utilization units belonging to the utilization unit group, the inflow of the refrigerant into the plurality of utilization units 2030 belonging to the utilization unit group may be suppressed by closing the first shutoff valve and the second shutoff valve. In other words, the shutoff valve device 2060 may be a device that suppresses inflow of the refrigerant into the plurality of utilization units 2030 by one first shutoff valve 2052 and/or one second shutoff valve 2054.

Supplementary Note

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

The present disclosure is widely applicable and useful to an air conditioner including a shutoff valve for preventing refrigerant leakage and an air conditioning indoor unit used in the air conditioner.

REFERENCE SIGNS LIST

30, 30*a*, 130: air conditioning indoor unit
32, 132: utilization heat exchanger (heat exchanger)
34: second expansion valve (first shutoff valve)
37*a*: liquid refrigerant pipe
37*b*: gas refrigerant pipe
40, 140: casing
46*a*: suction port (opening)
46*b*: blow-out port (opening)

52: first shutoff valve
54: second shutoff valve
60, 160: partition wall
100, 100*a*: air conditioner
144*a*: suction opening
144*b*: blow-out opening
481: suction opening (opening)
482: blow-out opening (opening)
R: air conditioning target space
S1: first space
S2: second space
1010: heat source unit (air conditioning heat source unit)
1030, 1030*a*: utilization unit (air conditioning indoor unit)
1034: second expansion valve (first shutoff valve)
1050: shutoff valve
1052: first shutoff valve
1054: second shutoff valve
1060, 1060*a*, 1060*b*: shutoff valve device
1062*a*: electric component
1064: main body casing (casing)
1064*a*: opening
1066: electric component box
1068: heat insulating material
1100: air conditioner
1000CL: ceiling
1000GP: gas-refrigerant connection pipe
1000LP: liquid-refrigerant connection pipe
1000R: air conditioning target space
1000S: attic space
2010: heat source unit (air conditioning heat source unit)
2030, 2030*a*: utilization unit (air conditioning indoor unit)
2034: second expansion valve (first shutoff valve)
2050: shutoff valve
2052: first shutoff valve
2054: second shutoff valve
2060, 2060*a*, 2060*b*: shutoff valve device
2062*a*: electric component
2064: main body casing (casing)
2064*a*: opening
2066: electric component box
2068: heat insulating material
2100: air conditioner
2000FL: floor
2000GP: gas-refrigerant connection pipe
2000LP: liquid-refrigerant connection pipe
2000R: air conditioning target space
2000S: underfloor space

PATENT LITERATURE

Patent Literature 1: JP 2018/011994 W
Patent Literature 2: JP 2013-19621 A

What is claimed is:

1. An air conditioning indoor unit that blows air, which has exchanged heat with a refrigerant flowing through a heat exchanger, into an air conditioning target space, the air conditioning indoor unit comprising:
a liquid refrigerant pipe and a gas refrigerant pipe that are connected to the heat exchanger;
a casing that accommodates the heat exchanger and that has an opening communicating with the air conditioning target space;
a first shutoff valve in the liquid refrigerant pipe;
a second shutoff valve in the gas refrigerant pipe; and
a partition wall that extends from a bottom plate of the casing to a top panel of the casing and divides a space inside the casing into a first space and a second space, wherein
the first shutoff valve and the second shutoff valve are in the first space, and
the second space communicates with the air conditioning target space via the opening.

2. The air conditioning indoor unit according to claim 1, wherein the air conditioning indoor unit is a ceiling-mounted type.

3. The air conditioning indoor unit according to claim 2, wherein the air conditioning indoor unit is a ceiling-embedded type.

4. The air conditioning indoor unit according to claim 2, wherein the first space communicates with an attic space.

5. An air conditioner comprising the air conditioning indoor unit according to claim 1.

6. An air conditioner comprising:
an air conditioning indoor unit in an air conditioning target space;
an air conditioning heat source unit connected to the air conditioning indoor unit via a liquid refrigerant pipe and a gas refrigerant pipe; and
a shutoff valve device comprising a shutoff valve group disposed in an attic space above a ceiling of the air conditioning target space, wherein
the shutoff valve group comprises:
a first shutoff valve in the liquid refrigerant pipe; and
a second shutoff valve in the gas refrigerant pipe,
the shutoff valve device further comprises a casing that accommodates the shutoff valve group,
the casing has an opening through which the liquid refrigerant pipe and the gas refrigerant pipe extend, and
the shutoff valve device further comprises a heat insulating material that closes only a gap between the opening and the liquid refrigerant pipe and a gap between the opening and the gas refrigerant pipe.

7. The air conditioner according to claim 6, wherein the air conditioning indoor unit is a wall-mounted type.

8. The air conditioner according to claim 6, wherein the air conditioning indoor unit is a floor type.

9. The air conditioner according to claim 6, wherein the air conditioning indoor unit is a ceiling suspended type.

10. The air conditioner according to claim 6, wherein
the shutoff valve device further comprises an electric component box that accommodates electric components that operates the shutoff valve group, and
the electric component box is disposed outside the casing.

11. An air conditioner comprising:
a floor-type air conditioning indoor unit in an air conditioning target space;
an air conditioning heat source unit connected to the floor-type air conditioning indoor unit via a liquid refrigerant pipe and a gas refrigerant pipe; and
a shutoff valve device comprising a shutoff valve group disposed in an underfloor space that is between a floor of the air conditioning target space and a ceiling of a floor immediately below the floor of the air conditioning target space, wherein
the shutoff valve group comprises one or both of:
a first shutoff valve in the liquid refrigerant pipe; and
a second shutoff valve in the gas refrigerant pipe.

* * * * *